US011313077B2

(12) United States Patent
Jones et al.

(10) Patent No.: US 11,313,077 B2
(45) Date of Patent: Apr. 26, 2022

(54) SYSTEM, CONTROL SYSTEM, AN INSPECTION SYSTEM, AND A METHOD OF CONTROLLING AND CLEANING A STEAM BOX

(71) Applicant: IBS of America, Chesapeake, VA (US)

(72) Inventors: Geoffrey Arthur Jones, Brockville (CA); Herbert Hans Tschinkel, North Vancouver (CA); Barnaby John Edward Smith, Brockville (CA); Manuela Bejan, Brockville (CA)

(73) Assignee: IBS of America, Chesapeake, VA (US)

( * ) Notice: Subject to any disclaimer, the term of this patent is extended or adjusted under 35 U.S.C. 154(b) by 0 days.

(21) Appl. No.: 17/065,705

(22) Filed: Oct. 8, 2020

(65) Prior Publication Data

US 2021/0108369 A1 Apr. 15, 2021

Related U.S. Application Data

(60) Provisional application No. 62/915,372, filed on Oct. 15, 2019.

(51) Int. Cl.
*D21F 7/00* (2006.01)
*D21G 9/00* (2006.01)

(52) U.S. Cl.
CPC ..... *D21F 7/008* (2013.01); *D21F 7/003* (2013.01); *D21G 9/0027* (2013.01)

(58) Field of Classification Search
CPC . D21F 7/008; D21F 7/003; D21F 7/00; D21F 5/02; D21G 9/0027
See application file for complete search history.

(56) References Cited

U.S. PATENT DOCUMENTS

| | | | | |
|---|---|---|---|---|
| 3,574,338 | A | 4/1971 | Shelor | |
| 3,945,881 | A | 3/1976 | Speidel | |
| 4,163,688 | A | 8/1979 | Kankaanpaa | |
| 4,253,247 | A | 3/1981 | Bergstrom | |
| 4,331,510 | A | 5/1982 | Wells | |
| 4,351,700 | A * | 9/1982 | Dove | D21F 7/008 162/252 |
| 4,545,857 | A | 10/1985 | Wells | |
| 4,580,355 | A | 4/1986 | Boissevain | |
| 5,077,913 | A | 1/1992 | Akerblom et al. | |
| 5,149,401 | A | 9/1992 | Langevin et al. | |

(Continued)

FOREIGN PATENT DOCUMENTS

| | | |
|---|---|---|
| EP | 1046746 A2 | 10/2000 |
| EP | 1310591 A2 | 5/2003 |

(Continued)

OTHER PUBLICATIONS

Valmet IQ Steam Profiler from https://www.valmet.com/tissue/automation-for-tissue/quality-management-solutions-for-tissue/steam-profiler/, printed Sep. 16, 2019.

(Continued)

*Primary Examiner* — Eric Hug
*Assistant Examiner* — Matthew M Eslami
(74) *Attorney, Agent, or Firm* — Young Basile Hanlon & MacFarlane, P.C.

(57) ABSTRACT

A system comprising: (a) housing; (b) support arm; and (c) rotary actuator that rotates a steam box between a working position and a rotated position.

18 Claims, 13 Drawing Sheets

(56) References Cited

U.S. PATENT DOCUMENTS

| | | | |
|---|---|---|---|
| 5,262,955 | A | 11/1993 | Lewis |
| 5,752,324 | A | 5/1998 | Muller et al. |
| 5,799,411 | A | 9/1998 | Schiel |
| 6,096,169 | A | 8/2000 | Hermans et al. |
| 6,254,731 | B1 | 7/2001 | Puurtinen et al. |
| 6,408,534 | B1 | 6/2002 | Alen et al. |
| 6,498,534 | B1 | 12/2002 | Kim et al. |
| 8,551,293 | B2 | 10/2013 | Faufau et al. |
| 9,045,859 | B2 | 6/2015 | Gauss et al. |
| 2005/0283995 | A1 | 12/2005 | Hamel |

FOREIGN PATENT DOCUMENTS

| | | | |
|---|---|---|---|
| EP | 1310591 | A3 | 5/2004 |
| EP | 2009177 | A2 | 12/2008 |
| RU | 2126864 | C1 | 2/1999 |
| SU | 19912 | A1 | 3/1931 |
| SU | 929776 | A1 | 5/1982 |
| WO | 9941450 | A1 | 8/1999 |
| WO | 2005116332 | A1 | 12/2005 |
| WO | 2013072560 | A1 | 5/2013 |

OTHER PUBLICATIONS

YouTube, video of Metso IQ Steam Profiler Animation available at <https://www.youtube.com/watch?v=4w3LEH4mhME>, last accessed Sep. 19, 2019.

Russian Federation Office Action and Search Report for Application No. 2020133779, dated Jun. 29, 2021.

Alashkevich, PPI Equipment, Part II, Paper Machines Study Guide, St. Petersburg, 2018.

European Search Report for Application No. 20202072.3, dated Mar. 17, 2021.

* cited by examiner

SYSTEM, CONTROL SYSTEM, AN INSPECTION SYSTEM, AND A METHOD OF CONTROLLING AND CLEANING A STEAM BOX

CROSS-REFERENCE TO RELATED APPLICATIONS

This application claims priority to and the benefit of U.S. Provisional Application Ser. No. 62/915,372, filed Oct. 15, 2019, the entire disclosure of which is hereby incorporated by reference.

FIELD

The present teachings relate to a system including a steam box, an inspection system for inspecting a steam box, and a control system for cleaning a steam box.

BACKGROUND

Typically, fourdrinier paper machines include a wet end with a wire that moves in a machine direction. The wire has a width (i.e., cross-machine direction) and stock is applied substantially along the entire width of the wire. A plurality of blades are located under the wire and the plurality of blades assist in removing water from the stock on the wire. The blades are typically static, however, more recently foils and blades that actuate have been added to the wet end. Typically, changes to the paper machine are made by a user adjusting machine characteristics such as a slice opening or machine speed based upon dry end test results. The paper may have a moisture profile in a cross-machine direction. The moisture profile may be controlled or adjusting using steam boxes that apply steam to paper from a location proximate to the paper, which may cause contamination of the steam boxes.

Examples of steam boxes are disclosed in U.S. Pat. Nos. 4,163,688; 5,077,913; 5,752,324; 5,799,411; 6,254,731; 6,498,534; U.S. Patent Application Publication No. 2005/0283995; and European Patent No. EP1310591; all of which are expressly incorporated herein by reference for all purposes. Thus, there is a need for a self-cleaning steam box. What is needed is device for verifying the cleanliness of the steam box after a cleaning cycle has been performed. What is needed is steam box that is movable (e.g., rotatable) away from paper passing by so that the paper is not contaminated while the steam box is being cleaned. What is needed is a monitoring system that visually inspects the surface of the steam box as the steam box is being cleaned. What is needed is a cleaning system that follows a shape of the steam box to remove debris from a first surface or edge to a second opposing surface or edge.

SUMMARY

The present teachings provide: a system comprising: (a) housing; (b) support arm; and (c) rotary actuator that rotates a steam box between a working position and a rotated position.

The present teachings provide: a system comprising: (a) a steam box; and (b) a monitoring system that monitors cleanliness of the steam box.

The present teachings provide: a system comprising: (a) a steam box; and (b) a cleaning system that moves relative to the steam box to clean the steam box.

The present teachings provide: a method comprising: (a) monitoring a steam box for cleanliness using a monitoring system; (b) cleaning a steam box with one or more cleaning devices that are movable about a face of the steam box; (c) rotating a steam box from a working position to a rotated position; (d) or a combination of a, b, and c.

The present teachings provide a self-cleaning steam box. The present teachings provide a device for verifying the cleanliness of the steam box after a cleaning cycle has been performed. The present teachings provide steam box that is movable (e.g., rotatable) away from paper passing by, so that the paper is not contaminated while the steam box is being cleaned. The present teachings provide a monitoring system that visually inspects the surface of the steam box as the steam box is being cleaned. The present teachings provide a cleaning system that follows a shape of the steam box to remove debris from a first surface or edge to a second opposing surface or edge.

DETAILED DESCRIPTION

Figure 1:
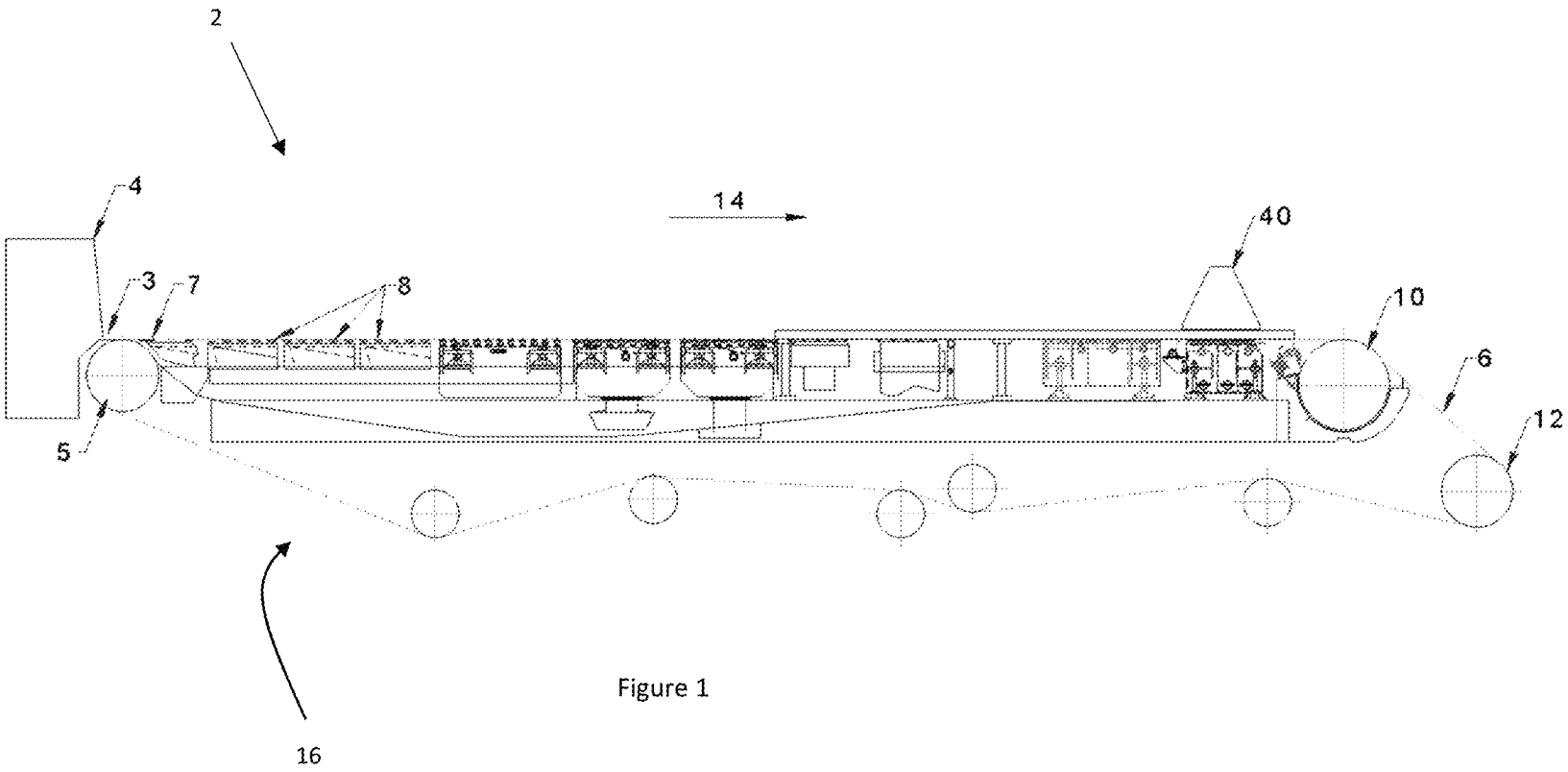
FIG. 1 is a perspective view a paper machine including a steam box and cleaning system.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings are predicated upon providing an improved system, control system, inspection system, method of controlling, or a combination thereof for a steam box of a paper machine. Preferably, the paper machine is a fourdrinier paper machine. The paper machine may be a twin wire paper machine, top wire former, gap former, tissue machine, cylinder mould machine, counter flow vat, Saint Ann's former, or a combination thereof. The paper machine may be any paper machine where stock or paper traveling in a machine direction may be monitored and controlled. The paper machine taught herein may be any paper machine that functions to create paper. The paper machine may be any style and/or type that forms paper. The paper machine may have a frame. The paper machine may have opposing frames. One frame may extend along a tending side and one frame may extend along a back side. The tending side of a paper machine may be a side where an operator or machine tender primarily works from. The back side of a paper machine may be a side of the paper machine opposite the tending side where the gears, motors, and equipment may be located, thus, accessibility of the paper machine may be limited. The paper machine may have one frame that extends in a cross-machine direction. The paper machine may have multiple frames that extend in the machine direction. The paper machine includes a headbox that applies stock in a wet end.

The headbox functions to apply stock to a wire. The headbox may apply stock to a wire, a forming board, or both. The headbox may be gravity fed, pressurized, or both. The headbox may apply stock at a speed slower than the speed a wire in the wet end is moving (e.g., drag mode). The headbox may apply stock at a speed faster than the speed a wire in the wet end is moving (e.g., rush mode). The headbox may apply stock substantially at the same speed as the wire in the wet end is moving (e.g., square mode). The headbox may function to apply stock to a wet end, above a breast roll, on foils, or a combination thereof. The headbox may function to apply stock to a wire while the wire passes over a forming board or over a forming section. The headbox may apply stock to the wire at a location proximate to a breast roll and a forming board. The headbox may have a top portion that is movable up and down. For example, a static head of fluid may be adjusted by moving a top of the headbox up or down, or the amount of stock applied to the wire may be adjusted by moving a top of the headbox up or down (e.g., adjusting a slice opening. The headbox may include one or more slice openings.

The slice opening may function to guide stock from the headbox onto the wire. The slice opening may vary a velocity of stock traveling onto a wire, a volume of stock onto a wire, an angle of stock approaching a wire, or a combination thereof. The slice opening may be adjusted. The slice opening may have a top portion or a bottom portion that are movable. The top portion may increase a height or decrease a height of a slice opening. The top portion may pivot so as to change an angle of the stock jet while increasing a distance between the top portion and the bottom portion. The bottom portion may be movable in the machine direction. The bottom portion may change a distance between the headbox and the forming board. The bottom portion, the top portion, or both may change an angle of the stock jet relative to the wire, the forming board, or both. The top portion, the bottom portion, or both may move in the machine direction (e.g., forward and backward); up and down (e.g., towards and away from the wire; pivot a portion towards or away from the wire; or a combination thereof. The slice opening may affect a contact location, contact angle, stock velocity, or a combination thereof of the stock jet relative to the wire, breast roll, forming board, forming section, or a combination thereof.

The stock jet functions to place stock on a wire while beginning to impart certain characteristics into the fibers in the stock. For example, if a stock jet is moving slower than a wire (e.g., drag) the fibers may tend to be aligned in the machine direction. In another example, if the stock jet is moving at a same speed as the wire the fibers may tend to be more randomly oriented than when the stock jet is in rush or drag.

The wire may be a porous continuous belt that travels between the breast roll and the couch roll and carries stock. The wire may be flexible enough to be moved and changed by the foils within the various foil sections. The wire may be metal, plastic, a polymer, woven, non-woven, or a combination thereof. The wire may be a felt material. The wire may include pores or be porous so that water may be removed from the stock but solids retained. The wet end may have a wire that travels in a machine direction with stock and the stock is dewatered as the wire moves in the machine direction. Preferably, the wet end includes an endless wire that travels in a machine direction. The width of the wire may extend in the cross-machine direction. The wet end may have opposing edges that may have stock that runs along a cross-machine direction and falls off the wire. The wet end may end with a couch roll (i.e., couch roll end) that functions to wrap the wire and guide the wire in a direction opposite the machine direction so that an endless wire is formed. One or more return rolls may be located after the couch roll to assist in returning the wire. The one or more return rolls may be free of contact with the paper. The couch roll may be the last roll in the wet end to come into contact with the paper.

The couch roll may function to dewater. The couch roll may include suction. The couch roll may be a vacuum roll. The couch roll may end the wet end. The couch roll may assist in guiding a sheet from the wet end into a press section. The stock may be sufficiently dry when the stock reaches the couch roll that the stock has paper like qualities and is self-supporting. The couch roll may assist in dewatering the stock so that the stock is sufficiently strong to exit the wet end or forming section of the paper machine. The stock may be sufficiently self-supporting once a dry line is visible in the stock. On or more steam boxes may be located proximate to the couch roll to dewater the stock so that the stock is sufficiently strong to move from the wet end to a press section.

Stock as discussed herein is a slurry of fibers mixed in water and optional paper chemicals to enhance certain final paper characteristics. Stock may include fiber, fines, filers, chemicals, virgin fibers, recycled fibers, synthetic fibers, mineral fibers, glass fibers, polymer fibers, or a combination thereof. The stock preferably is at 90 percent or more, 95 percent or more, or even 99 percent or more water at the headbox (e.g., has a consistency of about 1 percent or less stock and 99 percent or more water by weight). As the stock travels in the machine direction (i.e., a direction of movement from a wet end to a dry end) the foils or blades and groups of foils (e.g., foil sections) or groups of blades (e.g., blade sections) remove the water and consistency (i.e., percentage of water in the stock) decreases. Water may continually be removed from the stock as the stock travels toward the wet end. The stock at some point will go from being a primarily liquid state to being a primarily solid state, which is referred to a dry line (i.e., a visible point on the paper machine where the stock goes from dark to light (typically at a sheet consistency of between about 8 percent to about 10 percent)).

The dry line functions to indicate that a sheet is formed and the sheet is becoming solid. The water may be removed to a point where a "dry line" is visible. The dry line is a line that forms in the cross-machine direction (i.e., a direction 90 degrees to the machine direction) where a sufficient amount of water is removed so that the stock no longer appears glossy or wet. The dry line may be substantially straight. The dry line may be staggered and the dry line may appear at edges of the paper machine before the dry line appears in a center of the paper machine. For example, the dry line may appear to have one or more fingers. One or more steam boxes may be located downstream of the dry line. For example, the dry line may be located between the headbox and the one or more steam boxes.

The wet line may function to indicate a location on the paper machine where a sufficient amount of water is removed so that the stock no longer reflects light or has a mirrored appearance. The wet line may occur at a consistency of between about 5 percent and about 6 percent (i.e., about 5 percent solids and 95 percent water by weight). The wet line may indicate that sheet formation has occurred. The wet line may indicate that the fibers are immobilized. The one or more steam boxes may be located downstream of the wet line. The wet line may be located between the one or more steam boxes and the headbox.

The breast roll may be the first roll of the wet end (i.e., at the headbox end), may assist in formation, may remove water from the stock, or a combination thereof. The breast roll may be the lead roll in a wet end. The breast roll may be located proximate to the head box, the slice opening, or both. The breast roll may be located on an opposite end of the wet end as the couch roll in the machine direction (i.e., downstream). The couch roll may be a last roll on the wet end of the paper machine. The couch roll may be located between the wet end and the press sections. The wet end may function to receive stock and dewater stock. One or more forming boards, forming sections, or both may be located between the breast roll and the foil sections.

A forming section may be located downstream of the breast roll. The forming section may be located upstream of a couch roll. The forming section may function to assist in receiving stock from the slice opening and to assist in configuring the stock so that fibers in the stock are oriented in a desired orienting (e.g., machine direction, cross machine direction, random). The forming section may include one or more foils, one or more forming boards, or both. The first foil of all of the foil sections may be a forming board. The forming board may be static. The forming board may be movable in the machine direction. The forming board may move so that the distance between the forming board and the headbox is increased or decreased. The forming board may be height adjustable. The forming board may be angle adjustable. The forming board may be moved to increase or decrease the amount of water removed from the stock jet.

The wet end may be a portion of the paper machine where the paper has a consistency of about 15 percent or less or about 10 percent or less (i.e., 10 percent solids and 90 percent water). The wet end may be a portion of the paper machine that is located upstream of a press section. The wet end may receive stock that is primarily water and remove the water until a sheet is formed. The wet end may have one or more and preferably a plurality of foil sections (or blade sections). For example, the wet end may have a first section, second section, third section, fourth section, or more. The wet end may remove water from stock. The wet end may impart activity into the stock so that formation of the stock is controlled, formation of a sheet of paper is controlled, the fibers are oriented or reoriented, the fibers remain suspended within water.

The first section may function to begin dewatering stock as the stock exits the headbox, the slice opening, the forming board, the forming board section, or a combination thereof. The first section may include static foils, height adjustable foils, angle adjustable foils, or a combination thereof. The various foils may be alternating; only static; all height adjustable foils; all angle adjustable foils; height adjustable foils and angle adjustable foils; height adjustable foils and static foils; angle adjustable foils, height adjustable foils, and static foils; or a combination thereof. Preferably, the first section is a combination of angle adjustable foils and height adjustable foils; all height adjustable foils; or all angle adjustable foils. The first section may be vacuum assisted. The first section may be free of vacuum assistance. The first section may be located directly upstream of the second section.

The second section may function to continue dewatering stock as the stock travels in the machine direction. The second section may dewater stock that is exiting the first section. The second section may include static foils, height adjustable foils, angle adjustable foils, or a combination thereof. The various foils may be alternating; only static; all height adjustable foils; all angle adjustable foils; height adjustable foils and angle adjustable foils; height adjustable foils and static foils; angle adjustable foils, height adjustable foils and static foils; or a combination thereof. Preferably, the second section is a combination of static foils and height adjustable foils with vacuum assist. The second section may be vacuum assisted. The second section may be free of vacuum assistance. The second section may be located directly upstream of the third section.

The third section may function to continue dewatering stock as the stock travels in the machine direction. The third section may dewater stock that is exiting the second section. The third section may include static foils, height adjustable foils, angle adjustable foils, or a combination thereof. The various foils may be alternating between different types of foils; only static; all height adjustable foils; all angle adjustable foils; height adjustable foils and angle adjustable foils; height adjustable foils and static foils; angle adjustable foils, height adjustable foils, and static foils; or a combination thereof. Preferably, the third section is a combination of static foils on ends and angle adjustable foils located therebetween with the third section including vacuum assist. The third section may be vacuum assisted. The third section may be free of vacuum assistance. The third section may be followed by a fourth section, a vacuum section, steam boxes, a high vacuum section, or a combination thereof that may include blades or foils.

Blades and foils as discussed herein may be used interchangeably. The foil sections may each include one or more foils and preferably a plurality of foils. The foils may be height adjustable, angle adjustable, fixed, or a combination thereof. The foil sections may include one or more forming boards. The forming boards may be part of a forming board section. The forming board section may include height adjustable foils, angle adjustable foils, fixed foils, static foils, or a combination thereof. The foils and blades may be adjusted by any device as taught herein including devices taught in U.S. Pat. No. 8,551,293 in column no. 3, line 30 through column no. 10, and FIGS. 1-9B the teachings of which are expressly incorporated by reference herein regarding angle and height adjustable foil or blades. The foils or blades may be adjusted in angle and/or height as taught herein including devices taught in U.S. Pat. No. 9,045,859 in column 1, line 50 through Column 16, line 24 and FIGS. 1-9B the teachings of which are expressly incorporated by reference herein regarding angle and height adjustable foil blades including cam blocks, grooves, guide keys, connecting rods, thrust end blocks, pivots, foils, pneumatic, hydraulic, bending structure or a combination thereof. The wet end includes edges in a cross-machine direction (i.e., a direction that is perpendicular to a machine direction). The plurality of foils may be broken into one or more groups of foils and preferably a plurality of groups of foils that extend in the machine direction. The groups of foils may be all height adjustable, all angle adjustable, all static, or a combination thereof. The groups of foils may include both height adjustable foils and angle adjustable foils; both static and height adjustable, both static and angle adjustable; height adjustable foils, angle adjustable foils, and static adjustable foils; or a combination thereof. The types of blades may be alternating (e.g., static blades and height adjustable blades; static and angle adjustable blades; height adjustable blades and angle adjustable blades; or a combination thereof). The static blades may be located at a beginning and an end and angle adjustable or height adjustable blades may be located therebetween. The paper machine may include two or more groups of foils, three or more groups of foils, four or more groups of foils, or five or more groups of foils. Each group of foils may include two or more foils, four or more foils, six or more foils, or even ten or more foils. A first set of foils may include a forming board and then a set of foils. The types of foils (e.g., static, angle adjustable, height adjustable) may be grouped in any order. For example, the group of foils may include two angle adjustable foils then one static foil and the three height adjustable foils. Each foil may be a different type in an alternating fashion. For example, a static foil then height adjustable in a repeating pattern. The height adjustable foils may move a distance from a wire (e.g., out of contact with the wire). The height adjustable foils may move towards or away from the wire. The height adjustable foils may from away from the foil about ±1 mm or more, about ±2 mm or more, about ±3 mm or more, about ±4 mm or more, about ±5 mm or more, or about ±6 mm or more (e.g., when the foil moves towards the wire it is positive (or up) and when the foil moves away from the wire it is negative (or down)). When the height adjustable blades are in contact with the wire and the wire is not deflected then the height adjustable blades are at 0 mm. The angle adjustable blades may be adjustable in an angle from about ±1° or more, about ±2° or more, about ±3° or more, or about ±4° or more (e.g., when a tip of the blade is rotated into the wire (i.e., up pressing into the wire) the angle is positive and when the tip of the blade is rotated away from the wire (i.e., down moving away from the wire) the angle is negative, and when the tip is parallel to the wire the angle is 0°). The height adjustable foils may create vacuum on the wire that pulls the wire negative. The height adjustable foils may have a "v" shape and the valley of the "v" may assist in pulling the wire below 0° so that stock activity is created. The blades may be adjusted based upon one or more monitored conditions of a monitoring system. Preferably, a monitoring system monitors the stock at one or more locations between the headbox and the dry line or a press section. The monitoring system may monitor a steam box.

The monitoring system may monitor the wet end, stock activity, wet line, dry line, activity line, machine cleanliness, steam box cleanliness, or a combination thereof. Preferably, the monitoring system taught herein monitors the steam box. More preferably, the monitoring system monitors cleanliness of the steam box or fluid evenness exiting the steam box. The monitoring system may visually inspect a steam box, monitor pressure of the steam box, monitor back pressure of a steam box, monitor application regions, monitor application consistency, or a combination thereof. The monitoring system may include one or more static sensors, one or more movable sensors, or both. The monitoring system may operate while the steam box is being cleaned, after the steam box is being cleaned, or both. The monitoring may have one type of sensor that continuously operates and one type of sensor that intermittently operates. For example, a pressure sensor may continuously operate and a visual inspection device may operate during cleaning of the steam boxes.

The one or more sensors function to monitor pressure, cleanliness, debris, steam exiting a diffuser, or a combination thereof. The one or more sensors may function to send signals to a control system so that the control system controls a cleaning system, the steam box, valves, or a combination thereof. The one or more sensors may be located along a side of the paper machine, the steam box, or both. The one or more sensors may be located normal to a steam box. The one or more sensors may be located at an angle relative to the steam box. The one or more sensors may view an entire length of a steam box (e.g., a length of the steam box extending in the cross-machine direction). The one or more sensors may monitor a portion of a length of a steam box. Multiple sensors may be used to monitor an entire length of a steam box. Only a portion of a steam box may be monitored and a remainder of the steam box may be extrapolated based upon the monitored portion. For example, if a steam box is 10 m long, then 2 m may be monitored and 8 m of the steam box that is not monitored may be extrapolated based upon the sensing of the 2 m. A combination of sensor types may be used. Some sensors may monitor pressure. Some sensors may visually monitor. The sensors may use ultrasound, infrared, CMOS sensor, charge-coupled device, matrix camera, area scan camera, line scan camera, microwave, a temperature sensor, nuclear, capacitance, pressure, vacuum, distance, suspension height, pressure, back pressure, or a combination thereof. The one or more sensors may be a plurality of sensors or a multitude of sensors. All of the sensors may be the same type of sensor. Different types of sensors may be used together. For example, one sensor may be an infrared sensor and another sensor may be a CMOS sensor. The one or more sensors may be a color sensor. The one or more sensors may be monochrome sensor. The one or more sensors may be one or more sensors, two or more sensors, four or more sensors, six or more sensors, or even ten or more sensors. Each of the sensors may produce images that have a plurality of pixels. Each of the sensors may produce pixels that may be categorized. The one or more sensors may include an air purge. The one or more sensors may include a cleaning mechanism. The one or more sensors may include a self-cleaning lens. The one or more sensors may include a wipeable lens. For example, the wipeable lens may be a self-wiping lens that upon a pre-determined amount of build-up moves so that the debris is removed from the lens. The lens may move longitudinally or radially so that a cleaned lens is moved in front of the camera. The one or more sensors may include both a cleaning mechanism and an air purge. The one or more sensors may remove vapor, fluids, steam, debris, stock, or a combination thereof. The one or more sensors may be in a location so that the sensors are a high angle sensor, a low angle sensor, a movable sensor, or a combination thereof. A high angle sensor may be located above the device (e.g., steam box) being monitored. A low angle sensor may be located below the device (e.g., steam box) being monitored. A movable sensor may move along a length of the device being monitored. The sensors may be located coplanar with a surface being measured. The sensors may be normal to a surface being measured.

The one or more movable sensors may be located above the wet end and the one or more movable sensors may move in the machine direction, the cross-machine direction, or a direction therebetween. The one or more movable sensors may be located along a side of a wet end. The one or more movable sensors may be located under a wire of the wet end. The movable sensors may function to travel in a cross-machine direction along a surface of a steam box, in a radial direction or machine-direction along a surface of a steam box, or both. The movable sensors may move along a surface of a steam box after the surface is cleaned to determine if debris has been removed. The movable sensors may be connected on a frame, a wire, may be a drone, may be free of connection with any devices, may be suspended from a ceiling, may be suspended from a spray bar, suspended from a shower, suspended from a brush, connected to a movement arm, connected to an actuator (e.g., an actuator that moved in the cross-machine direction), or a combination thereof. The movable sensors may zoom in, zoom out, or both. The movable sensors may be movable with a light so that an area of interest is illuminated while the movable sensor moves. The movable sensors may move in the cross machine direction. The movable sensors may move in the machine direction. The movable sensors may move diagonally. The movable sensors may be a plurality of sensors. The movable sensors may be a camera, a thermal camera, a temperature sensor, or a combination thereof. The movable sensors may be wired, wireless, use Bluetooth, use wifi, use radio waves, or a combination thereof. The movable sensors may be in communication with other sensors and may move to a location of interest based upon measurements taken by other sensors. The movable sensors and other sensors may be in communication with the control system and the control system may control where the movable sensor senses based upon feedback detected by the sensors (e.g., the high angle sensors, the low angle sensors, or both). The movable sensor may operate without a light (i.e., in ambient conditions). The movable sensor may move with a light so that as the movable sensor moves the light moves to illuminate an area of interest.

The one or more lights function to illuminate an area of interest. The one or more lights may be static or movable. The one or more lights may be a strobe light. The one or more lights may always be on. The one or more lights may only turn on during a cleaning cycle. The one or more lights may be sufficiently bright so that a visual inspection may be performed. The lights may have a brightness of about 1 million candela or more, 2 million candela or more, 3 million candela or more, or 10 million candela or less. The light, sensor, monitoring system, or both may be located proximate to a steam box, a vacuum roll, or both.

The vacuum rolls may function to more water from stock, paper, a forming sheet of paper, or a combination thereof. The vacuum rolls may be a couch roll. The vacuum roll may be a passive vacuum roll (i.e., have holes that receive and remove fluid). The vacuum roll may be an active vacuum roll (i.e., have suction that draws fluid into the roll). The vacuum roll may be located in a wet end. The vacuum roll may be located in a press section. The vacuum roll may be located proximate to a dryer. The vacuum roll may be located proximate to a Yankee dryer.

The Yankee dryer may function to remove water from paper. Preferably, the Yankee dryer removes water from tissue, tissue paper, paper toweling, toilet paper, or a combination there. The Yankee dryer may be free of direct contact with a steam box. The Yankee dryer may be located after a steam box. The steam box may introduce fluid to the paper so that once dried by the Yankee dryer the moisture profile of the paper may be consistent in the cross-machine direction (e.g., a fluctuation of about 5 percent or less, or about 3 percent or less in moisture content).

The one or more steam boxes function to remove water, dry the paper, add water, add steam, level a cross-machine moisture profile, reduce variation of a moisture profile in a cross-machine direction (e.g., reduce the variation in moisture to ±10 percent or less, ±5 percent or less, or even ±3 percent or less), or a combination thereof. The one or more steam boxes may be located in the wet end. The steam boxes may be located in the press section. The steam boxes may be located proximate to a dryer. One or more steam boxes may be located in the wet end. For example, one steam box may be located proximate to a foil section and one steam box may be located proximate to a vacuum roll. The steam boxes may be located between foil sections. The one or more steam boxes may be located above a vacuum. A wire or felt may be located between the steam box and the paper or a sheet. Preferably, a steam box may be directly located above paper or a sheet of paper being created. The steam boxes may mirror a shape of the paper at a location that the steam box is located. A face of the steam box may mirror a shape of the paper or a roller. For example, if the paper is between a roll and a foil the steam box will be flat and if the paper is wrapping a roll then the steam box may have a curved shape. The steam box, a face of the steam box, or both may include a coating. The coating may be a non-stick coating. The coating may be a hardening coating to prevent wear. The coating may be or include polytetrafluoroethylene (PTFE), anodized, hard-anodized aluminum, a ceramic coating, or a combination thereof. The one or more steam boxes may include a housing that protects internal components, directs steam towards a sheet of paper, maintains the steam box in a location, or a combination thereof.

The housing may function to support the steam box at a predetermined location. The housing may direct steam in a predetermined direction. The housing may be an external shell that holds diffusers, valves, steam headers, connects to support arms, connects to linear actuators, connects to rotary actuators, has pivot points, has zone feed pipes, has guides, has slides, or a combination thereof. The housing may contain all of the elements of the steam box discussed herein and the housing may be moved and the components of the steam box may be moved with the housing. The housing may be made of metal or plastic. Preferably, the housing is made of stainless steel. More preferably, the housing is made of 316 stainless steel or a corrosion resistant alloy. The housing may be substantially closed at locations where steam is not desired so that steam is directed towards one or more diffusers.

The diffusers function to permit fluid and/or steam to exit the housing, the steam box, or both. The diffusers may spread the steam so that the steam is applied evenly or substantially evenly to a location of interest. The diffuser may be a single plate that extends a full width of a paper machine in the cross-machine direction. The diffuser may be a plurality of plates that are connected together (e.g., with fasteners, welding, a frame, or a combination thereof). The diffuser may be a plurality of discrete plates that are located end to end. The diffusers may be flat. The diffusers may be curved. The diffusers may per perforated. The diffusers may include a plurality of holes or perforations. The diffusers may include slots (e.g., oval holes), slits (e.g., elongated oval holes or substantially two-dimensional holes), a geometric hole, an asymmetric hole, a symmetric hole, or a combination thereof that supplies the steam to a location of interest. The diffusers may be one or more plates that cover a valve, a zone feed pipe, or both so that as steam is fed towards the diffuser the diffuser assists in spreading the steam over a predetermined surface area. There may be one diffuser over a cross-machine length of the steam box. Preferably, there are a plurality of diffusers along a cross-machine length of the steam box. For example, every one foot or more or two feet or more may begin a new diffuser. There may be one or more or two or more diffusers in the machine direction. For example, two or more diffusers may be stacked side by side to form a face of the diffuser at a predetermined location. Two diffusers may be located proximate to each other and the steam may be applied in gaps between the diffusers. Preferably, the steam is applied through the diffusers. The diffusers may include a chamber. The diffuser may include two or more, three or more, or four or more chambers. The chambers may control an application of steam within a zone. The diffuser may be a zone box or each section of a diffuser may be a zone box. One diffuser may have multiple zones or zone boxes that distribute steam from one or more zone feed pipes. The diffusers may include a face plate or may be a face plate. A portion of a diffuser may be a face plate. The face plate may be a portion of a diffuser that is located proximate to paper, that paper contacts, is an outer most surface of a steam box, or a combination thereof. The diffuser, the face plate, or both may include a coating. The coating may be a non-stick coating. The coating may be a hardening coating to prevent wear. The coating may be or include polytetrafluoroethylene (PTFE), anodized, hard-anodized aluminum, a ceramic coating, or a combination thereof. The diffuser may allow a predetermined amount of steam through in a predetermined amount of time. Preferably, the diffuser applies all of the steam that is metered and the diffuser spreads out the steam over a predetermined area. Each diffuser may be located proximate to or cover one valve. Each diffuser may cover one, two, three, four, five, six, or more valves.

The valves function to provide steam, meter steam, or both to a predetermined location. The valves may be controlled so that a moisture profile of the paper is controlled. The valves may open or close to increase heat, increase moisture, increase drying, or a combination thereof of a sheet. The valve may be electronically controlled by a controller. The valves may be in electrical communication or signal communication with a scanner, a distributed control system (DCS), or both. The valves may be open any percentage from zero percent to 100 percent or any percentage therebetween. An openness or a closeness of one valve may be independent of another valve. For example, one valve may be opened to fifty percent, another valve to sixty percent, a third valve to twenty percent, and yet another valve to ninety percent. The valves may be in fluid communication with one or more steam headers.

The one or more steam headers may supply steam from a boiler or steam source to the steam box, the valves, the zone feed pipes, or a combination thereof. The steam header may supply a sufficient amount of steam that each zone feed pipe, each valve, or a combination thereof is able to supply as much steam as needed. For example, if every valve is open 100 percent each of the valves will be able to supply substantially the same amount of steam. The steam header may be movable with the steam box. The steam header may include a flexible region so that as the steam box laterally moves, rotationally moves, or both the steam header is still connected to the steam box. The steam header may supply steam to a valve, the valve may meter steam to the zone feed pipe within the steam box, and then the zone feed pipe may supply steam to a diffuser that diffuses the steam and applies the steam to paper.

The one or more zone feed pipes may transport steam from the valves to the diffuser so that the diffuser distributes the steam to the paper as the paper is passing by the steam box. The zone feed pipes function to supply the steam to the diffuser. The feed zones be located evenly spaced out in the cross-machine direction. The zone feed pipes may be distributed so that a cross-machine moisture profile may be controlled, adjusted, or both. The zone feed pipes may extend between a diffuser and a steam header. The zone feed pipe may move with a steam box when a steam box is moved but will remain static relative to the steam box and the steam box moves relative to the support arms.

The one or more support arms function to support a steam box relative to paper or stock so that steam may be applied to the paper or stock. A support arm may be located on one side and the steam box may extend cantilever in the cross-machine direction. Preferably, a support arm is located on each end of the steam box. A support arm may be located in a center or between the ends of the steam box as long as the support arms do not interfere with the paper machine or the paper being produced. The support arm may be made of metal or plastic. The support arm may be sufficiently strong to support the steam box and associated components. The support arms may include one or more guides.

The one or more guides may function to control or restrict movement of a slide, a steam box, or both. The one or more guides may allow for movement in one direction but restrict movement in a second or third direction. The guides may be a track that a slide, a steam box, or both moves along. The guides may be a track that determines a movement of the steam box. The guides may be substantially straight so that as the steam box moves along the guides the orientation of the steam box remains constant. The guides may include one or more curves so that as the steam box or slide moves along the guide the steam box both laterally (or longitudinally moves) and rotationally moves relative to the rolls, the support arms, or both. The guide may change the orientation of the steam box as the steam box is moved so that the steam box is rotated. When the guide assists in rotating the steam box, only a single actuator may be needed. For example, as the steam box moves along the support arm the steam box may rotate. The guide may work with an actuation device that rotationally moves the steam box, linearly moves the steam box, or both. The guides may move the steam box in a predetermined pattern so that the steam box is moves away from a roll, paper, wire, or a combination thereof and then returns to the roll, paper, wire, or a combination thereof to continue working. The guides may be an absence of material in the support arms. The guides may have a shape that is square, rectangular, round, oval, "S" shaped, "V" shaped, "N" shaped, "W" shaped, "M" shaped, "Z" shaped, or a combination thereof. The guides may be a part of the support arm that is located proximate to or connected to one or more actuators. The support arm may be connected to or include a linear actuator, a rotary actuator, or both.

The linear actuators function to move the steam box away from adjacent components (e.g., a wire, paper, roll, or a combination thereof) so that a space is created between the steam box and adjacent components. The linear actuator may move the steam box in a straight line. The linear actuator may move the steam box about the support arm, along the support arm, or both. The linear actuator may be connected to the steam box at a center of gravity so that as the steam box moves the steam box maintains is orientation. The linear actuator may be connected to a steam box at a location proximate to a pivot, at a pivot, or both so that as the steam box moves, the steam box pivots relative to the support arm and an orientation of the steam box relative to a roll, wire, paper, or a combination thereof changes. The linear actuators may move the steam box in the cross-machine direction, away from the paper, away from the wire, or a combination thereof. The linear actuator may be or include a piston, servo motor, a chain driven device, a belt driven device, have an electric motor, a pump, be screw driven, pressure driven, gears, cogs, chains, be telescoping, or a combination thereof. Preferably, the linear actuator moves the steam box along a plane or line. The linear actuator may be servo motor or actuator that moves the steam box linearly or in a linear motion.

The rotary actuator functions to cause rotational movement of the steam box. The rotary actuator and the linear actuator may be the same device. For example, the steam box may be rotated by movement along a guide and the actuator may only have a linear motion. The rotary actuator may be a different device from the linear actuator. The rotary actuator may operate at the same time as the linear actuator. The rotary actuator may operate after the linear actuator. The rotary actuator may be connected to a pivot point. The rotary actuator may be connected to the support arm (directly or indirectly). The rotary actuator may be connected to a slide. The rotary actuator may be connected to a rotation arm that assist in rotating the steam box. The rotary actuator may be an identical device as the devices discussed herein for the linear actuator. Preferably, the rotary actuator may be a servo motor or actuator that moves the steam box rotationally by the rotary actuator pushing a rotary arm linearly about a pivot. The rotary actuator may be located at an angle relative to the support arm so that the rotary actuator rotates the steam box relative to the support arm as the steam box is rotationally moved about a pivot. An angle of the rotary actuator relative to the support arm may determine an amount of rotation of the steam box about the pivot. The angle of the support arm and the rotary actuator may determine an amount of travel of the steam box when the steam box is in the working position, the retracted position, or both. The angle may be about 15 degrees or more, about 25 degrees or more, about 45 degrees or more, about 60 degrees or more, or about 75 degrees or more when the steam box is in the working position, the retracted position, or both. The angle may be about 180 degrees or less, about 150 degrees or less, about 135 degrees or less, about 105 degrees or less, or about 95 degrees or less when the steam box is in the working position, the retracted position, or both (±5 degrees). The angle of the rotary actuator, in the rotated position, relative to the support arm may determine an amount of rotation of the steam box. The angle may be about 5 degrees or more, about 10 degrees or more, about 15 degrees or more relative to the support arm when the steam box is in the rotated position (the angle may be a negative angle (i.e., the rotary actuator may rotate a rotary arm past a plane of the support arm)). The angle may be about 90 degrees or less, about 60 degrees or less, about 25 degrees or less relative to the support arm when the steam box is in the rotated position (the angle may be a negative angle (i.e., the rotary actuator may rotate a rotary arm past a plane of the support arm)). The rotary actuator may rotate the rotation arm about a pivot to change a rotational orientation of the steam box.

The pivot may function to allow rotational movement of the steam box relative to a frame, a support arm, a roll, paper, a wire, or a combination thereof. The pivot may assist in moving the steam box away from the paper machine so that when the steam box is cleaned the debris do not contaminate the paper or paper machine. The pivot may include one or more bearings. The pivot may be a low friction surface (e.g., two plastic pieces or plastic and metal that move relative to one another). The pivot may be a joint. The pivot may be an axis. The steam box may move about the pivot. The pivot may be an ear that is located external of the steam box and is received in a bearing or a sleeve. The pivot may extend into a rotation arm or be in contact with a rotation arm so that as the rotation arm is moves the steam box pivots.

The rotation arm functions to rotate the steam box, brush, sprayer, or a combination thereof between two or more positions. The rotation arm functions to move the steam box, brush, sprayer, cleaning device, or a combination thereof. The rotation arm is connected to an actuator (e.g., a rotary actuator). The rotation arm when moved rotates a steam box, brush, sprayer, cleaning device, or a combination thereof. The rotation arm may rotationally move the steam box as the seam box is move linearly. The rotation arm may rotate by contacting a guide, extending along a guide, contacting a support arm, or a combination thereof. The rotation arm may be contacted by an actuator to move the steam box, brush, sprayer, cleaning device, or a combination thereof about a pivot. The steam box may have a single rotation arm (on a tending side, on a back side). Preferably, the steam box has two rotation arms, one on each side. The rotation arm may extend outward from a pivot. The rotation arm may provide a mechanical advantage. The rotation arms may be a cylinder, a gear, a chain, a cable, or a combination thereof. The rotation arm may be a cantilever device. The rotation arm may be connected at a pivot. The rotation arm may be connected to a sleeve of a pivot. The rotation arm may be located above or proximate to a slide.

The slide may function to linearly move the steam box, rotationally move the steam box, support the steam box within or relative to a support arm, or a combination thereof. The slide may move within a guide and the guide may dictate the movement of the steam box. For example, if the guide is straight then the steam box may move in a straight line. If the guide is curved then the steam box may move in a curved pattern. The slide may be directly connected to an actuator (e.g., a linear actuator). The slide may have a complementary shape to the shape of the guide. The slide may be round, square, rectangular, oval, octagonal, pentagonal, or a combination thereof. The slide assist in moving the steam box along the support arm while restricting movement of the steam box. The slide may move the steam box toward and away from a cleaning system.

The cleaning system may function to clean the steam box, the diffuser, the valves, the zone feed pipes, a suction roll, a suction press roll, a press roll, a roll that includes holes, a roll that includes through holes, a hole that includes divots, screens, rolls that include suction, rolls that may have portions that may become clogged or dirty, a or a combination thereof. Preferably, the cleaning system cleans the diffusers. The cleaning system may pneumatically clean, hydraulically clean, mechanically clean, or a combination thereof. The cleaning system may span an entire cross-machine direction. The cleaning system may move along the cross-machine direction to clean the steam box. The cleaning system may include one or more zones or regions along the cross-machine (e.g., banks of nozzles). The cleaning system may work in conjunction with a monitoring system to clean the steam box, the diffusers, or both. The cleaning system may perform one or more steps or stages of cleaning. The cleaning system may operate during operation, a sheet break, start up, intermittently, in a timed manner, periodically, or a combination thereof. The cleaning system may operate when a downstream sensor senses inconsistent moisture profile readings that may indicate contamination. The cleaning system may operate when a pressure sensor indicates back pressure, an increase in back pressure, or both. The cleaning system may include one or more pneumatic or hydraulic cleaning devices, one or more mechanical cleaning devices or both. The cleaning system may include a cleaning carriage or be a cleaning carriage.

The cleaning carriage may function clean a steam box, a distributer, or both. The cleaning carriage may move along the steam box in a cross-machine direction. The cleaning carriage may connect to the steam box. The cleaning carriage may be retained proximate to the steam box. The cleaning carriage may directly connect to the steam box. The cleaning carriage may be indirectly connected to the steam box. The cleaning carriage may include showers, brushes, or both. The cleaning carriage may include one or more showers, two or more showers, three or more showers, or four or more showers. The cleaning carriage may include 10 or less showers, 8 or less showers, or 6 or less showers. The cleaning carriage may include one or more brushes, two or more brushes, three or more brushes, or four or more brushes. The cleaning carriage may include 10 or less brushes, 8 or less brushes, or 6 or less brushes. The cleaning carriage may mechanically clean, hydraulically clean, or both as the cleaning carriage moves along the steam box. The cleaning carriage may clean when the steam box is in the retracted position, rotated position, or both. The cleaning carriage may include one or more connectors.

The one or more connectors function to connect the cleaning carriage to the steam box, the support frame, a support track, or a combination thereof. The connectors may permit movement of the cleaning carriage along the steam box, the support frame, the support track, or a combination thereof. The connectors may assist in creating a force. The connectors may press one or more brushes into contact with a face of the steam box. The connectors may retain the cleaning carriage in a position and then the steam box may be moved into contact with the cleaning carriage. The connectors may connect to a support frame, a support track, or both. The connectors may permit cross-machine movement. The cleaning carriage may include one or more, two or more, three or more, or four or more connectors. The connectors may be one or more movement members.

The movement members may function to permit movement of the cleaning carriage relative to the steam box, the support frame, the support track, or a combination thereof. The movement members may be located on opposing edges or sides of the steam box, cleaning carriage, or both. The movement members may connect to a support track. The cleaning carriage may include one or more, two or more, three or more, or four or more movement members. Each corner of the cleaning carriage may include a movement member. The movement members may be located in a center portion of a cleaning carriage. The movement members may assist in drawing the brushes into contact with the diffuser. The movement members may move in the cross-machine direction. The movement members may suspend the cleaning carriage from the steam box. The movement members may be a low friction sliding member. For example, the movement members may be a static piece that connects to another static piece. The movement members may be a plastic, poly, polymer, or a combination thereof that slides along another part. The movement members may be coated or include a coating. The movement members may be or include polytetrafluroethane. The movement members may rotate about a pivot or axis. The movement members may be a movement member or a wheel. The movement members may be a wheel, a roller, both. The movement member may extend around a support track. The movement member may connect to an end of a support track. The movement members may move along a support frame or support track.

The support track may connect to the movement member. The support track may be part of cleaning carriage. The support track may be part of a support frame. The support track may extend along a length, in a cross-machine direction, of the paper machine. The support rack may extend parallel to the steam box. A portion of the steam box may include or be the support track. The support track may be flat. The support track may have a point or a peak. The support track may have a rail. The support track may allow the cleaning carriage to directly connect to the steam box. The support track may support the cleaning carriage proximately to the steam box. The support track may indirectly connect the cleaning carriage to the steam box. The support track may permit movement along a frame, cross-machine movement, movement along a face of a steam box, or a combination thereof. The support track may receive a roller. The support track may allow a cleaning carriage to be added and removed from the steam box. The support track may prevent removable of a cleaning carriage from any location but a loading or unloading portion of a steam box. The support track may be connected to or part of a support frame.

The support frame may function to support a portion of the paper machine, the steam box, the cleaning system, the cleaning carriage, or a combination thereof. The support frame may be a metal structure. The support frame may span in the machine direction. The support frame may span in the cross-machine direction. The support frame may be static. The support frame may support a removal system.

The removal system may function to prevent debris, contaminants, fluids, or a combination thereof from falling into a paper machine during cleaning. The removal system may move with the cleaning carriage. The removal system may follow after the cleaning carriage. The removal system may extend a length of the cleaning carriage. The removal system may move along the steam box. The removal system may be a static piece located under the steam box. The removal system may include a vacuum, a basket, a drain, a storage box, or a combination thereof. The removal system may prevent debris, contaminants, fluid, or a combination thereof from falling on the paper, wire, felt, or a combination thereof. The removal system may direct debris, contaminants, fluid, or a combination thereof into a broke pit, under the paper machine, a sewer, or a combination thereof. The removal system may passively collect items removed during cleaning. The removal system may actively collect items removed during cleaning. The removal system may redirect items removed during cleaning to a location outside of the paper machine. The pneumatic or hydraulic cleaning device (herein after FCD (i.e., fluid cleaning device) may function to clean by directing a fluid into contact with the steam box, the diffuser, or both. The FCD may direct a fluid at the steam box, diffuser, or both. The FCD may be free of direct contact. The FCD may remove debris by spraying the debris so that the debris is floated away, blown away, softens, or a combination thereof. The FCD may spray air, water, or both. The FCD may apply water, grey water, or both. The FCD may supply a sufficient amount of water so that any debris (e.g., paper, paper dust, stickies, chemical build-up) are softened and removed. The FCD may spray in a direction a diffuser faces. The FCD may spray air on the diffuser to remove dry paper dust. The FCD may spray a fluid if the debris is wet paper. The FCD may apply a fluid at a pressure of about 0.7 MPa or more, about 1.5 MPa or more, about 3.5 MPa or more, about 5 MPa, about 10 MPa or more, about 15 MPa or more, about 20 MPa or more, about 25 MPa or more, about 30 MPa or more, or even about 35 MPa. The FCD may apply a fluid at a pressure of about 100 MPa or less, about 75 MPa or less, about 50 MPa or less, or about 40 MPa or less. The FCD may spray air first then water. The FCD may spray water then air. The FCD may include a bar with one or more nozzles. Preferably, the FCD includes a plurality of nozzles that extend along a bar in a cross-machine direction. The FCD may include one or more rows of nozzles. The FCD may include 2, 3, 4, 5 or more rows of nozzles. Preferably, the FCD includes one row of nozzles.

The nozzles function to supply a fluid to the steam box, the diffuser, or both. The nozzles function to assist in removing or moving debris, paper, paper dust, or a combination thereof from the steam box, the diffuser, or both. The nozzles may deliver a sufficient amount of fluid to clean the steam box or diffuser. The nozzles each may supply about 0.25 L/min or more, about 0.5 L/min or more, about 1 L/min or more, or even about 2 L/min or more. The nozzles each may support about 10 L/min or less, about 7 L/min or less, about 5 L/min or less, or about 3 L/min or less. The nozzles may be spaced a distance apart. A distance between the nozzles may depend upon a spray distance. The nozzles may be spaced apart so that there is some overlap of the spray of each nozzle. The nozzles may be spaced evenly along a cross-machine direction of the paper machine. The nozzles may be arranged in groups or banks (hereinafter banks).

The banks function to allow nozzles to operate separately from other banks of nozzles. The banks may divide the steam box into regions. The regions (or banks) may be divided along a longitude (cross-machine direction) of the steam box, laterally (machine direction), or a combination of both. The cleaning system may include one or more banks, two or more banks, three or more banks, five or more banks, seven or more banks, or even ten or more banks. The cleaning system may include 20 or less banks, 15 or less banks, or 12 or less banks. The number of banks may be determined by a cross-machine length of the steam box, a desired pressure of fluid exiting the nozzles, or both. The banks of nozzles may all operate simultaneously. The banks of nozzles may be individually turned on or off. Each bank of nozzles may be controlled separately. The banks may be controlled to operate sequentially, randomly, in groups, or a combination thereof. The banks may be operated to determine a pressure of fluid out of the nozzles. If less pressure is desired then more banks may be on and if more pressure is desired then more banks may be turned off. The banks may be operated after an inspection to re-clean an area within that bank. Each bank may be operated one or more times during a cleaning cycle. Some banks may be operated once and some banks may be operated a plurality of times. The number of banks operated may be determined on a desired fluid pressure or flow from the nozzles. The size of the banks (i.e., number of nozzles) may be selected based upon a size of a pump in the system. For example, all of the banks may be operated together to wet a face of the steam box and then once the face is wetted some banks may be turned off to increase pressure for cleaning. The nozzles may be used before, during, or avert a mechanical cleaning device.

The mechanical cleaning device (MCD) may function to directly contact the steam box, the diffusers, or both to remove debris. The MCD may brush, scrape, or both the steam box, the diffuser, or both. The MCD may follow the FCD, contemporaneously clean with the FCD, clean after the FCD, or a combination thereof. The MCD may remove moistened materials, loosen materials, or both. The MCD may be a rotary brush. The MCD may be a metal brush, a polymer brush, or both. The MCD may move from a starting position to an ending position to clean the diffuser. The MCD may clear plugs in a through hole within a diffuser. The MCD may extend into holes or through holes in a diffuser. The MCD may rotate in the direction of movement. The MCD may rotate in an opposing direction of movement. The MCD and FCD may be located on the same movement arm. The MCD and FCD may be located on different movement arms. The MCD and FCD may be used in series or in parallel. The MCD and FCD may extend one or more times, two or more times, or three or more times across a face of a diffuser. The movement arm may move the MCD and FCD across a face of the diffuser, steam box, or both.

The movement arm may function to move to move the MCD, the FCD, or both so that a diffuser is cleaned. The movement arm may rotate about a pivot. The movement arm may retract the MCD, the FCD, or both when not in use. The movement arm may move between a stored position and a start position. The movement arm may move between a start position and an end position. The movement arm may move between an end position and a stored position. The movement arm may move a brush, a plurality of nozzles, or both. The movement arm may be located on a side and a second side of a paper machine. The movement arms may be moved by one or more actuators.

The actuators function to move the movement arm. The actuators may move the MCD, the FCD, or both. The actuators may create movement along a face of a steam box, a diffuser, or both. The actuator may be any actuator discussed herein for a linear actuator, a rotary actuator, or both. Preferably, the actuator is a linear actuator. The actuator may move in a straight line and the movement arm may move along an arcuate path. The actuator may move the movement arm about an actuator.

The cleaning pivot allows the MCD, the FCD, or both to rotate or more. The cleaning pivot may pivot between an end position, a start position, a stored position, or a combination thereof. The cleaning pivot may be a bearing. The cleaning pivot may be a part of the movement arm extending into a sleeve to form a movable connection. The cleaning pivot may be located at an end of the movement arm. The cleaning pivot may be located opposite an attachment point of an actuator. The cleaning pivot may permit the MCD, the FCD, or both to move between a start position and an end position.

The start position may be a first side or end of a steam box, diffuser, or both. The start position may be on an upstream side or end of a steam box, diffuser, or both. The start position may be on a downstream side or end of a steam box, diffuser, or both. The start position may be where the MCD, the FCD, or both begin cleaning. The MCD, the FCD, or both may move from the start position to the end position one or more times.

The end position may be a location where the MCD, the FCD, or both stop cleaning. The end position may be where the MCD, FCD, or both exit an end or side of the steam box, diffuser, or both. The end position may be a position where a sprayer, brush, or both are located at one edge or side of the steam box, diffusers, or both. The end position may only exist when the steam box is in a rotated position.

The rotated position may be a position where the steam box faces away from a roll, paper, felt, wire, or a combination thereof. The rotated position may be where the steam box is moved to a position where the contaminates removed from the steam box, are prevented from contaminating the paper machine. The contaminates may fall into a broke pit, onto a floor, or both. The cleaning system may collect contaminates or debris when the steam box is in the rotated position, a cleaning position, or both. The rotated position may face downward so that contaminants fall away from a paper machine. The rotated position may be where a face of the steam box is parallel to a direction of gravity, or rotated past a direction of gravity (e.g., an angle of less than 90 degrees relative to a plane parallel to a floor). The rotated position may only occur when the steam box is in a retracted position.

The retracted position may be a position where the steam box is moved away from a working position, a roll, paper, felt, wire, or a combination thereof. The retracted position may be a steam box that is linearly moved. The retracted position may be a steam box that is not rotated and moved away from a working position. The retracted position may also have a rotated position. The rotated position may be created after a retracted position is created. The steam box may rotate as the steam box moves towards a retracted position. The steam box may fully move to a retracted position before the steam box moves to a rotated position. The steam box may move from a working position to a retracted position, a rotated position, or both.

The working position may be where the steam box is located proximate to paper. The working position may be a steam box located proximate to a roll, felt, wire, or a combination thereof. In the working position, rotated position, or both a pressure gauge may be used to monitor pressure within the steam box.

The one or more pressure gauges function to monitor a pressure of the steam box, zone feed pipe, steam header, at a valve, or a combination thereof. The one or more pressure gauges may monitor back pressure. The one or more pressure gauges may monitor pressure during use. The one or more pressure gauges may monitor cleanliness through an amount of pressure being applied through the distributers. The one or more pressure gauges may be used to check cleanliness after the cleaning cycle is used. The one or more pressure gauges may be used to determine if cleaning is needed. The one or more pressure gauges may be used in a method.

The method may include one or more of the steps discussed herein in virtually any order unless specified. The method may include a step of linearly moving the steam box. The method may include a step of rotating the steam box. The step of linearly moving occurs after the step of rotating. The steam box may monitor pressure. The monitoring system may monitor pressure, back pressure, or both. The monitoring system may include pressure sensors, visual sensors, or both. The monitoring system may monitor the steam box through a moisture profile. The monitoring system may visually inspect for debris, paper, dust, or a combination thereof located on the distributers, the steam box, or both. The monitoring system may monitor during use. The monitoring system may monitor during cleaning. The monitoring system may monitor after a cleaning cycle is performed. The monitoring system may include one or more sensors. The monitoring system may include two or more sensors, three or more sensors, or four or more sensors. The monitoring system may move one or more sensors. The monitoring system may compare one sensor to another sensor. The monitoring system may compare a reading to a prior reading. For example, if a visual profile is known then a profile after cleaning can be compared to the know profile to determine if debris are still present on the steam box. The monitoring system may include one or more lights. The monitoring system may turn on and off one or more lights. The monitoring system may be part of a cleaning system. The cleaning system may include one or more cleaning devices. The method may include a step of blowing air at the steam box, distributers, or both. The method may include a step of spraying water at the stem box, the distributers, or both. The method may include a step of spraying water and air simultaneously. The method may include a step of brushing the steam box, the distributers, or both. The brushing may be a movement in one direction. The brushing may be a continuous rotary brush. The brushing may occur after air or water are applied. Brushing may occur before air or water are applied. Brushing may be applied while air, water, or both are applied. The step of applying water, air, brushing, or a combination thereof may occur one or more times, two or more times, or three or more times before one cleaning step is performed. After one cleaning step is performed then a step of monitoring may be performed. A step of brushing may include applying a fluid through the brush. The mechanical cleaning may be a direct contact cleaning. The mechanical cleaning may be a scraper that is passed over the steam box, the diffuser, or both. The mechanical cleaning may be pneumatically driven, hydraulically driven, or both. The method includes a step of rotating the FCD between a starting position and an ending position. The FCD may be moved in one or more directions across the steam box, the diffuser, or both. The FCD may move in two or more directions across the steam box, the diffuser, or both. The steam box, the diffuser, or both may be monitored using the monitoring system taught herein.

FIG. 1 illustrates a side view of a paper machine 2 from a tending side 16. The paper machine 2 include a headbox 4 with a slice opening 3 that places stock proximate to a forming board 7 and onto a wire 6. A breast roll 5 is located proximate to the headbox 4. A plurality of foil sections 8 are located downstream of the forming board 7 and the headbox 4 in the machine direction 14. An end of the wet end of the paper machine 2 includes a couch roll 10 and a return roll 12. As shown, a steam box 40 is located after the foil sections 8 and is located above the wire 6, stock, and the couch roll 10.

Figure 2:
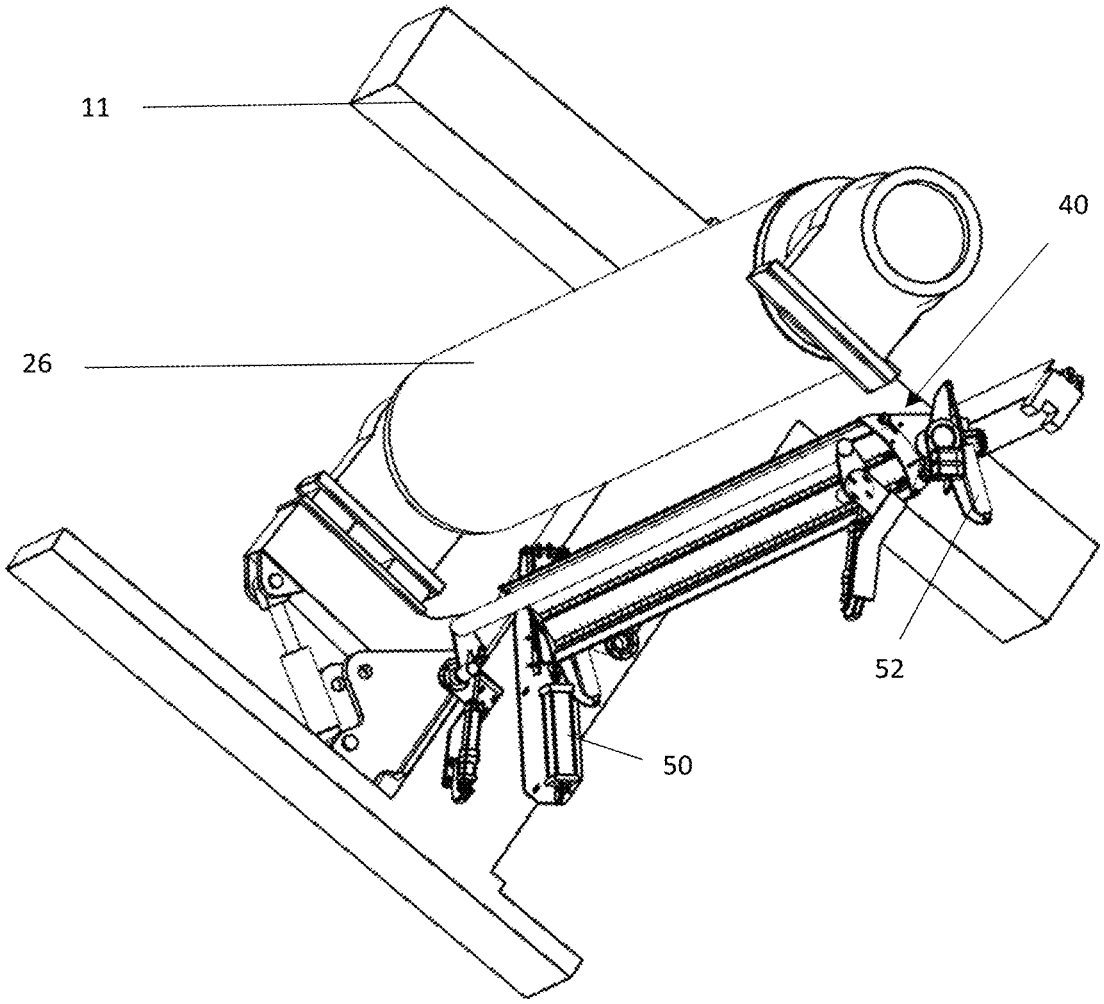
FIG. 2 is bottom perspective view of a steam box and cleaning system.

FIG. 2 is a bottom perspective view of a frame 11, vacuum roll 26, and a steam box 40. The team box 40 is movable by a linear actuator 50 and a rotary actuator 52.

Figure 3:
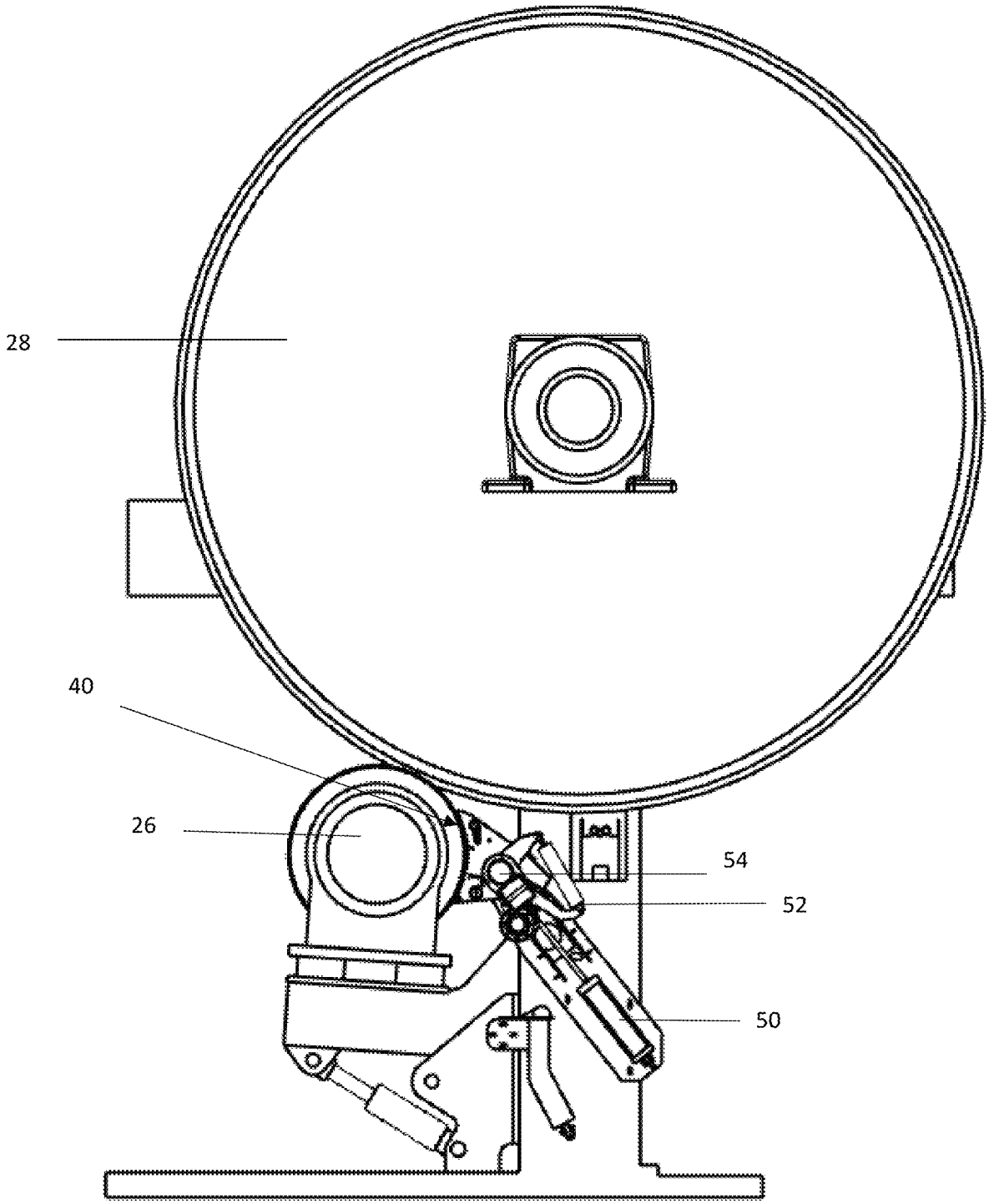
FIG. 3 is a side view of a steam box in a working position.

FIG. 3 is a side view of a Yankee Dryer 28 that is in communication with a vacuum roll 26. Paper (not visible) passes around the vacuum roll 26 under the steam box 40 and between the vacuum roll 26 and the Yankee Dryer 28. The steam box 40 is pivotable about a pivot 42 when the rotary actuator 52 is moved. The steam box 40 is longitudinally movable by the linear actuator 50.

Figure 4A:
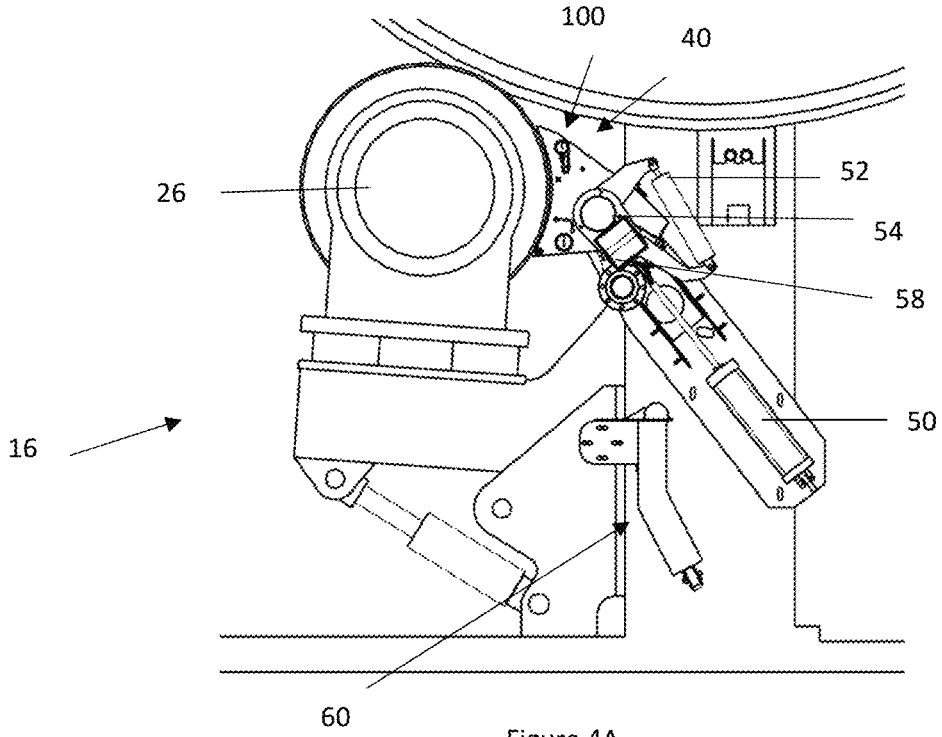
FIG. 4A is a tending side view of a steam box in a working position.

FIG. 4A is a tending side 16 view of a steam box 40 in a working position 100. The steam box 40 is proximate to the vacuum roll 26. The rotary actuator 52 lifts and rotates the steam box 40 about a pivot 54 to a location by the vacuum roll 26. A linear actuator 50 moves a slide 58 to move the steam box 40 to the vacuum roll 26. A cleaning system 60 is located below and proximate to the steam box 40 and as shown is in a stored position.

Figure 4B:
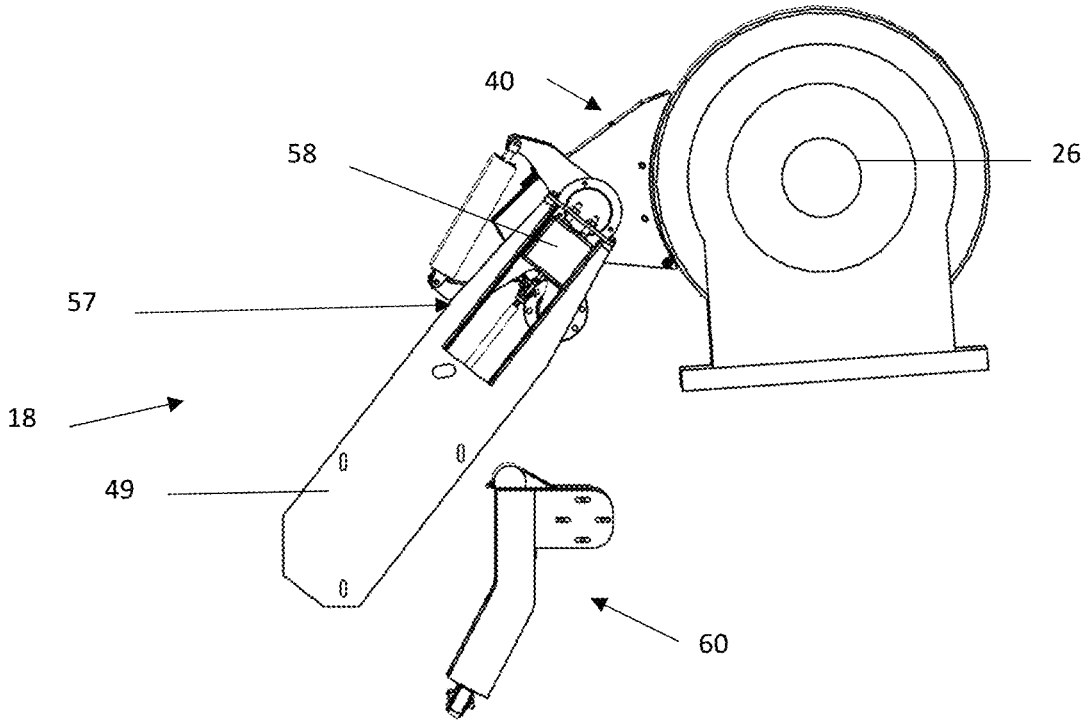
FIG. 4B is a back side view of the steam box in a working position.

FIG. 4B is a back side 18 view of a steam box 40. A slide 58 is located within a guide 57 of a support arm 49 to guide the steam box 40 as it moves. The cleaning system 60 is located underneath the steam box 40.

Figure 5A:
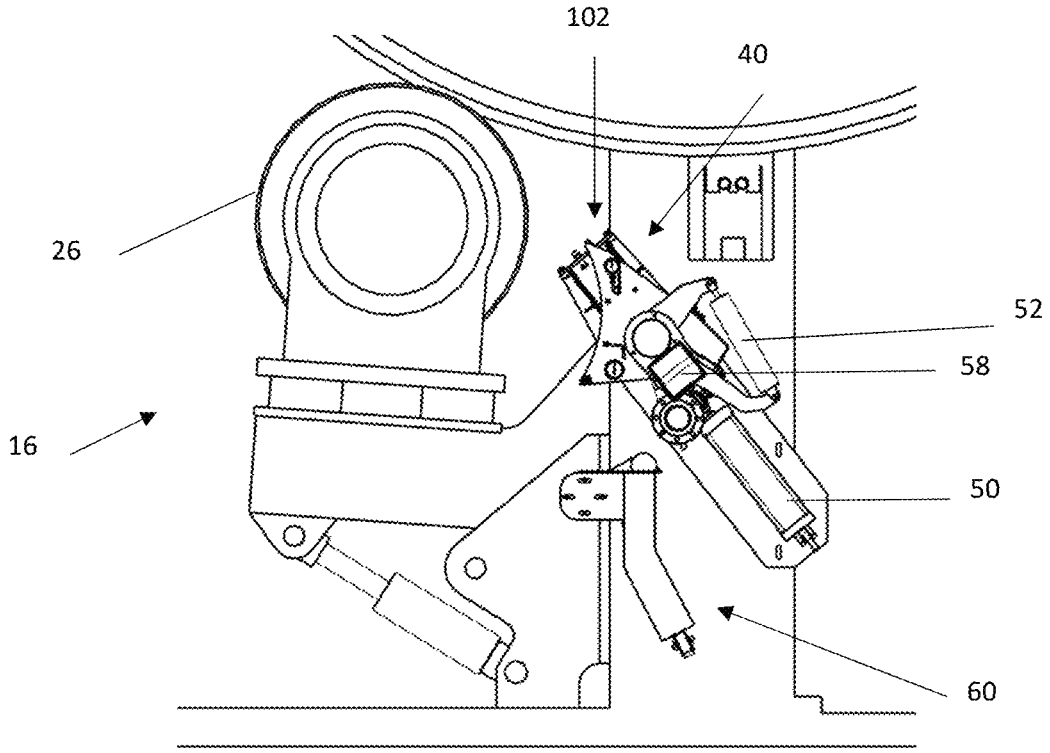
FIG. 5A is a tending side view of a steam box in a retraction position.

FIG. 5A is a tending side 16 view of a steam box 40 in a retracted position 102. The steam box 40 is moved away from the vacuum roll 26. The rotary actuator 52 maintains the steam box 40 in a rotated position while the slide 58 is moved downward by the linear actuator 50. Proximate to the steam box 40 is a cleaning system 60.

Figure 5B:
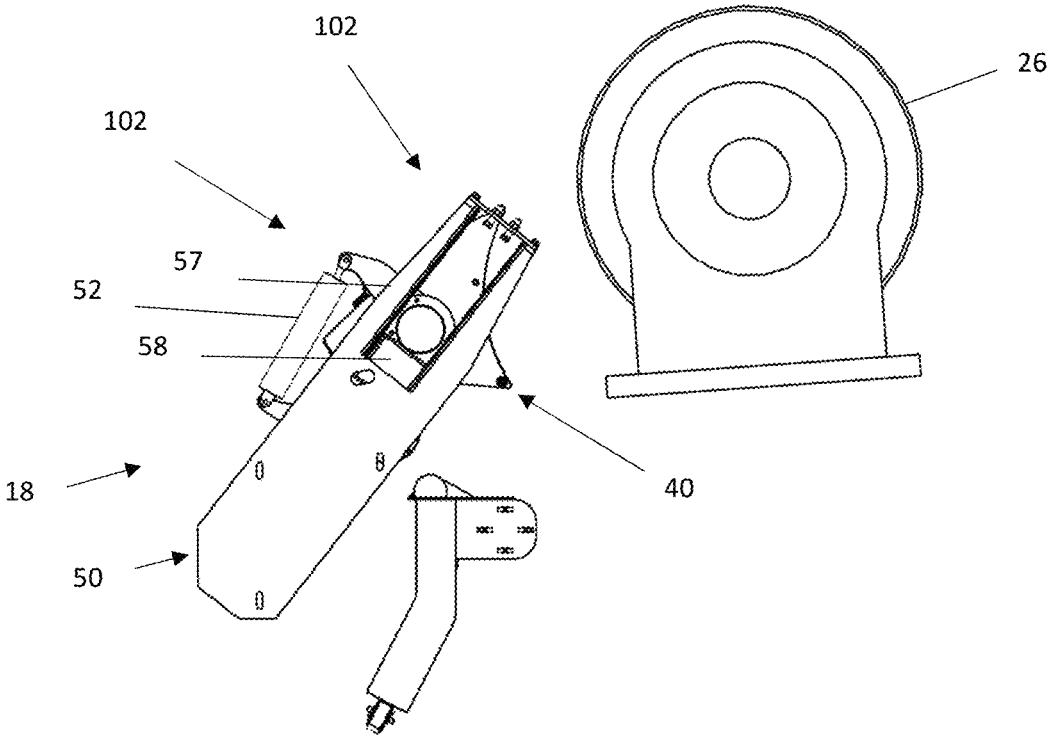
FIG. 5B is a back side view of a steam box in a retracted position.

FIG. 5B is a back side 18 view of a steam box 40 moved away from the vacuum roll 26 by the linear actuator 50. As the linear actuator moves 50, the slide 58 is moved along the guide 57. The rotary actuator 52 maintains the steam box 40 in an upright position.

Figure 6:
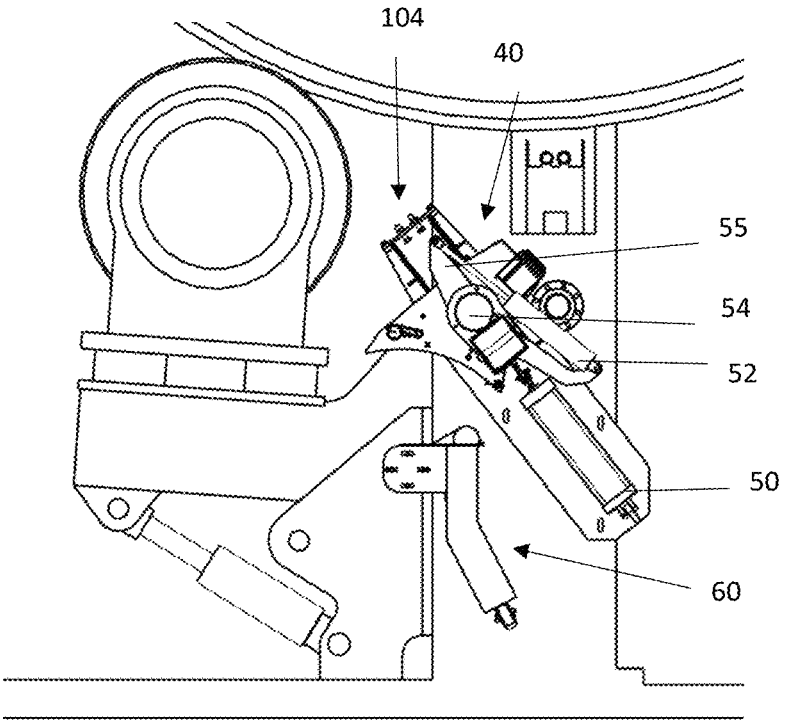
FIG. 6 is a side view of a steam box in a rotated position.

FIG. 6 is a side view of the steam box 40 rotated to a rotated portion (or cleaning position) 104. In the rotated position the steam box 40 is rotated about a pivot 54 by the rotary actuator 52 moving a rotation arm 55 of the steam box 40. The linear actuator 50 has already moved the steam box linearly so that the steam box 40 is moved proximate to the cleaning system 60.

Figure 7:
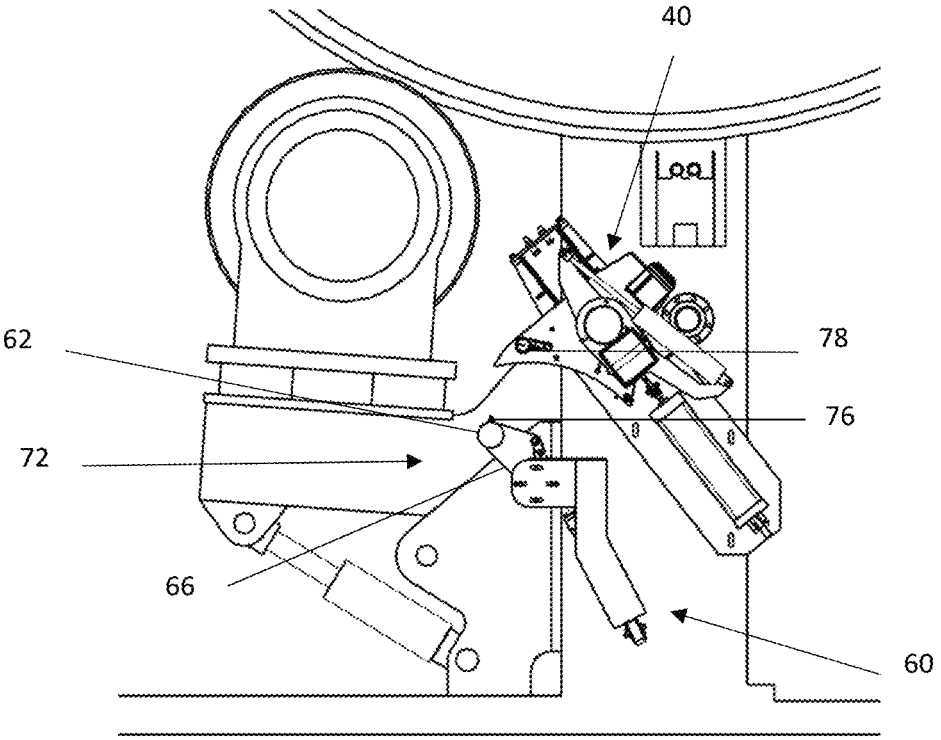
FIG. 7 is a side view of a steam box in a rotated position with a cleaning system in a start position.

FIG. 7 is a side view of the steam box 40 rotated downward and the cleaning system 60 in a start position 72. In the start position 72, the movement arm 66 moves the pneumatic or hydraulic cleaning device (e.g., shower) 62 and the nozzle 76 to a first side of the steam box. The steam box 40 includes a pressure gauge 78 that assist in monitoring pressure within the steam box 40.

Figure 8:
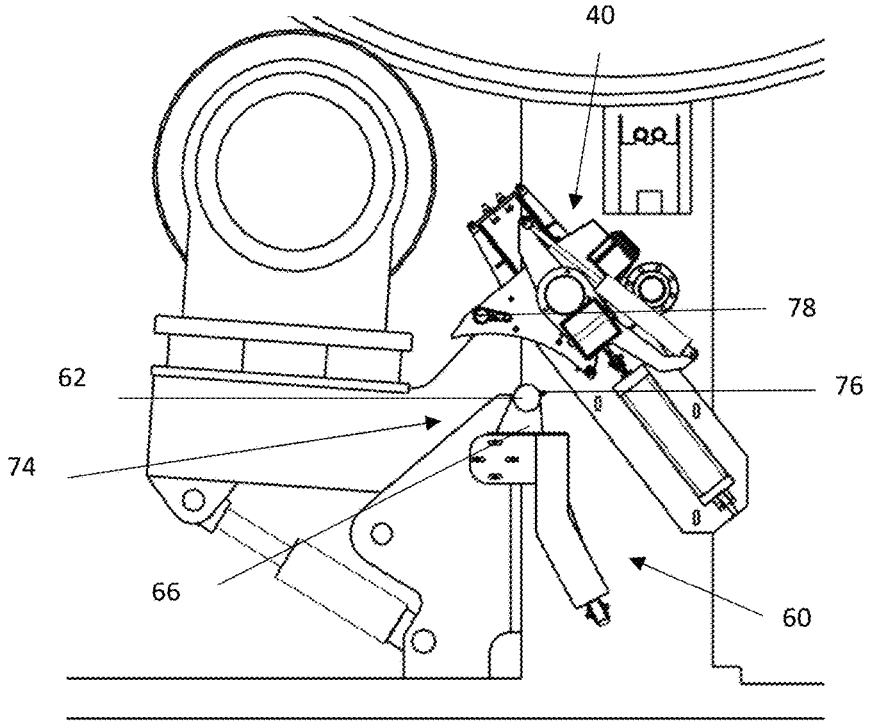
FIG. 8 is a side view of a steam box in a rotated position with a cleaning system in an end position.

FIG. 8 is a side view of the steam box 40 rotated downward and the cleaning system 60 in an end position 74. In the end position 74, the movement arm 66 moves the pneumatic or hydraulic cleaning device 62 and the nozzle 76 to a second side of the steam box. The steam box 40 includes a pressure gauge 78 that assists in monitoring pressure within the steam box 40.

Figure 9:
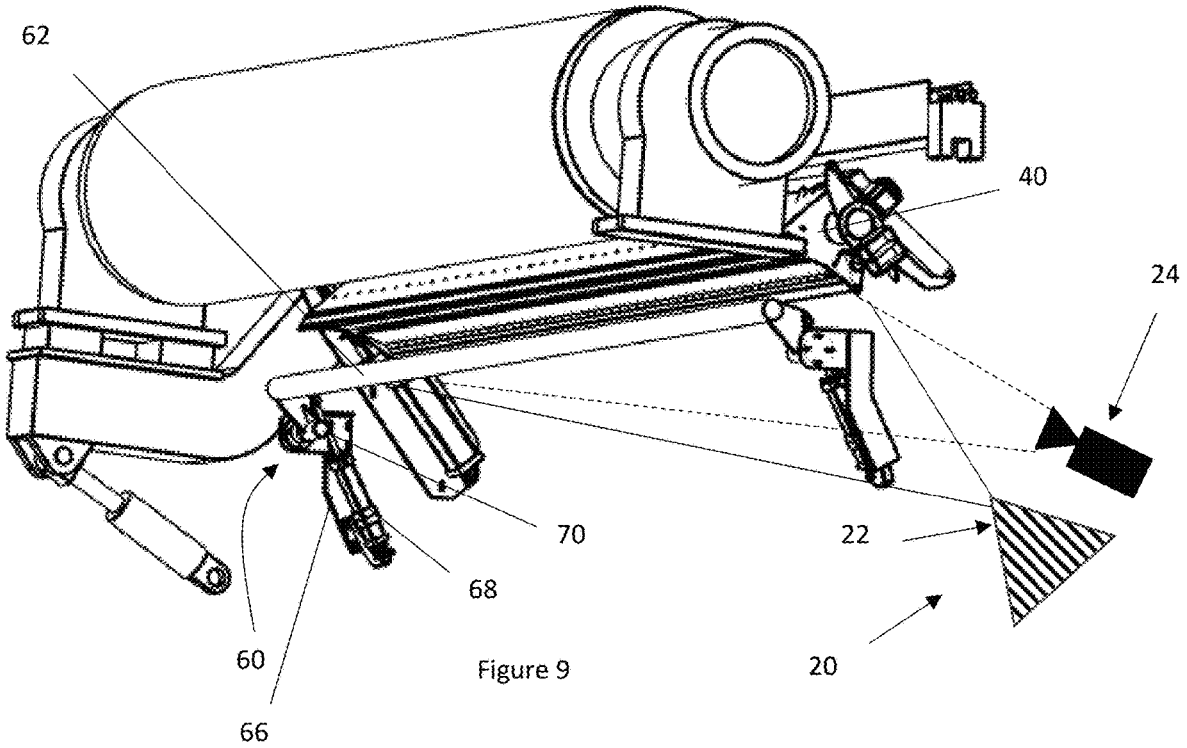
FIG. 9 illustrates bottom perspective view of a monitoring system monitoring the steam box.

FIG. 9 is a bottom perspective view of the cleaning system and the monitoring system 20. The monitoring system 20 includes lights 22 and sensors 24 that inspect the steam box 40 after a cleaning cycle is performed. A pneumatic or hydraulic cleaning device 62 has a cleaning pivot 70 at both ends and an actuator 68 that moves the pneumatic or hydraulic cleaning device 62 relative to the movement arm 66 so that the steam box 40 is cleaned.

Figure 10:
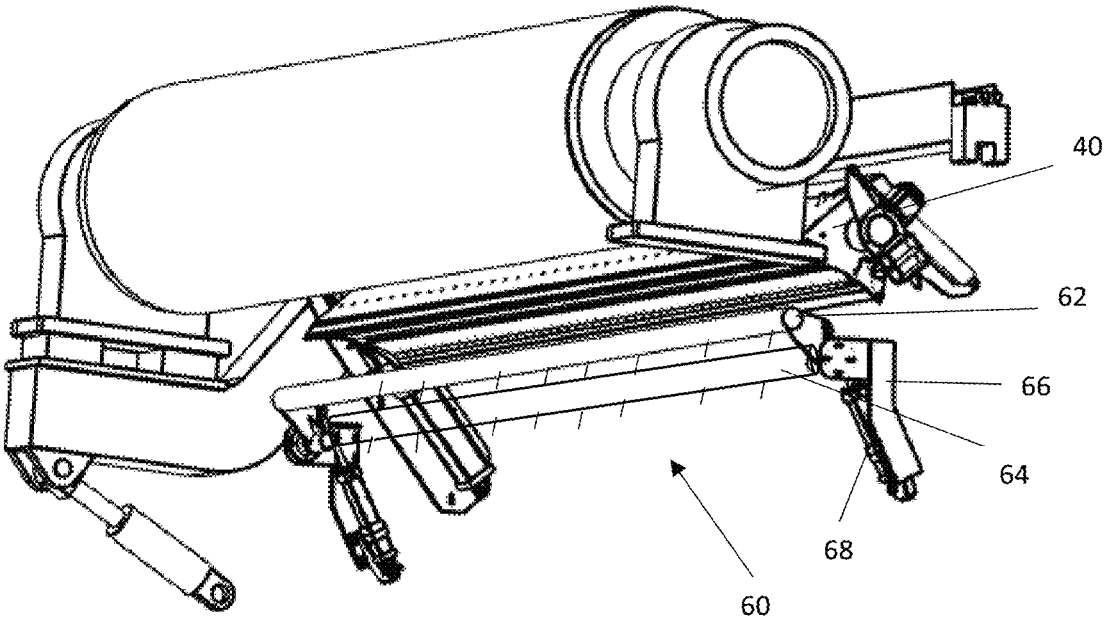
FIG. 10 is a bottom perspective view of a cleaning system.

FIG. 10 illustrates a cleaning system 60 with a pneumatic or hydraulic cleaning device 62 and a mechanical cleaning device (e.g., brush) 64 that work in conjunction to clean the steam box 40. The pneumatic or hydraulic cleaning device 62 and mechanical cleaning device 64 are movable by an actuator 68 about a movement arm 66.

Figure 11:
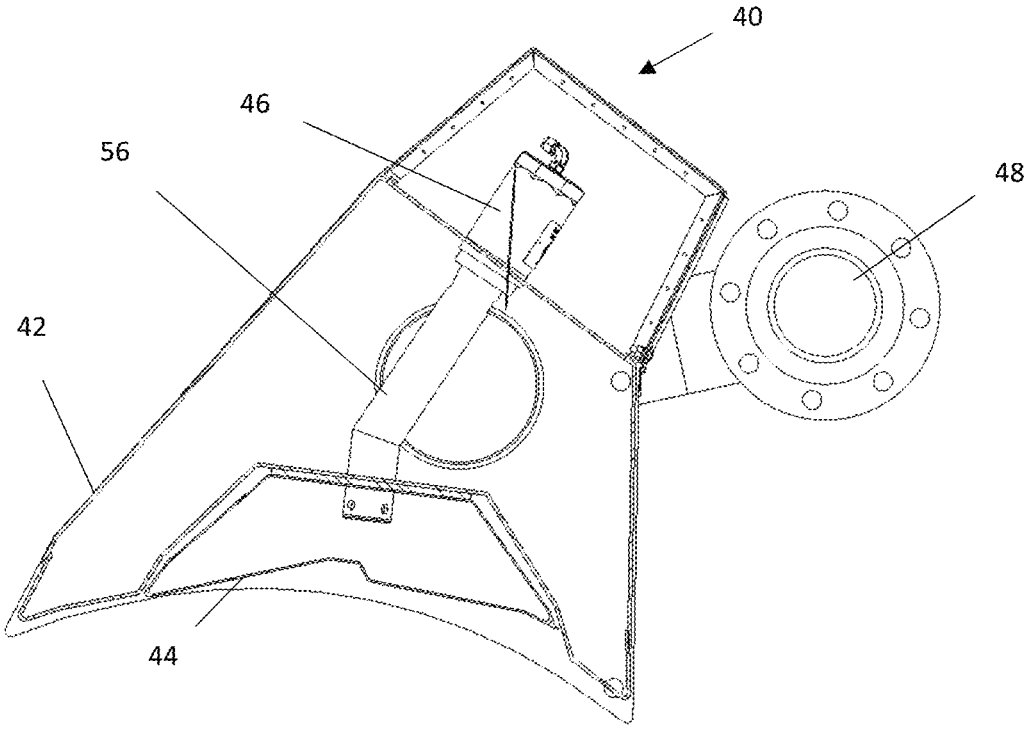
FIG. 11 is a cross-sectional view of a steam box.

FIG. 11 is a cross-sectional view of a steam box 40. The steam box 40 includes a housing 42 that holds a valve 46 connected to a zone feed pipe 56 that feeds a fluid (e.g., steam) to a diffuser 44, which applies the fluid to stock and/or paper (not shown). A steam header 48 feeds steam into the steam box 40 and a valve 46 controls an amount of steam applied to a sheet of paper being created (not shown).

Figure 12:
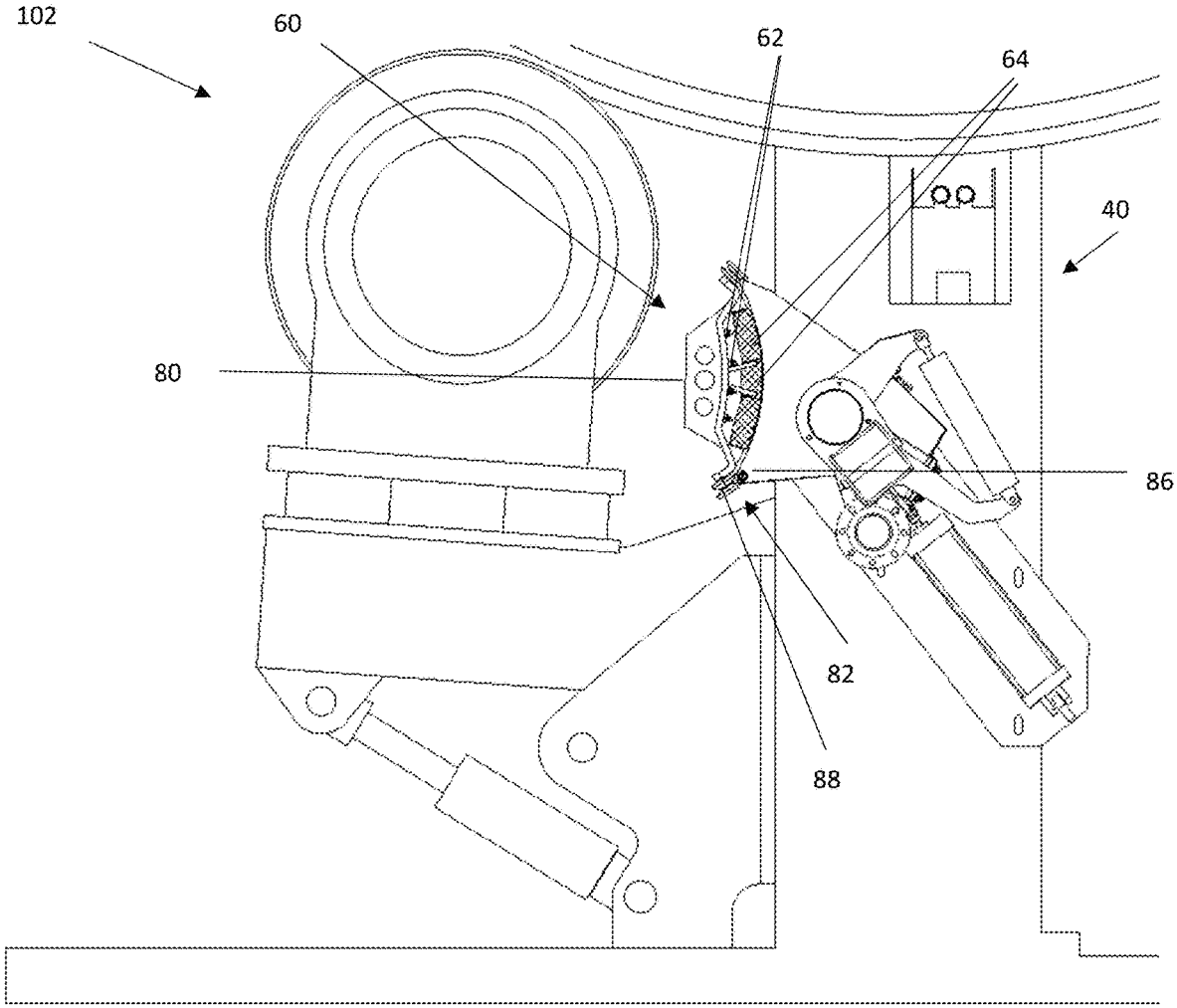
FIG. 12 is a side view of a cleaning system connected to and cleaning a steam box.

FIG. 12 is a side view of a steam box 40 with a cleaning system 60. The cleaning system 60 includes a cleaning carriage 80 that moves along the steam box 40. The cleaning carriage 80 includes showers 62 and brushes 64 that clean the steam box 40 as the cleaning carriage 80 moves along the steam box 40. The cleaning carriage 80 includes a connector 82 including movement members 88 that are shown as rollers, which move along a support track 86. The cleaning carriage 80 as shown is cleaning the steam box 40 while the steam box is in the retracted position 102.

Figure 13:
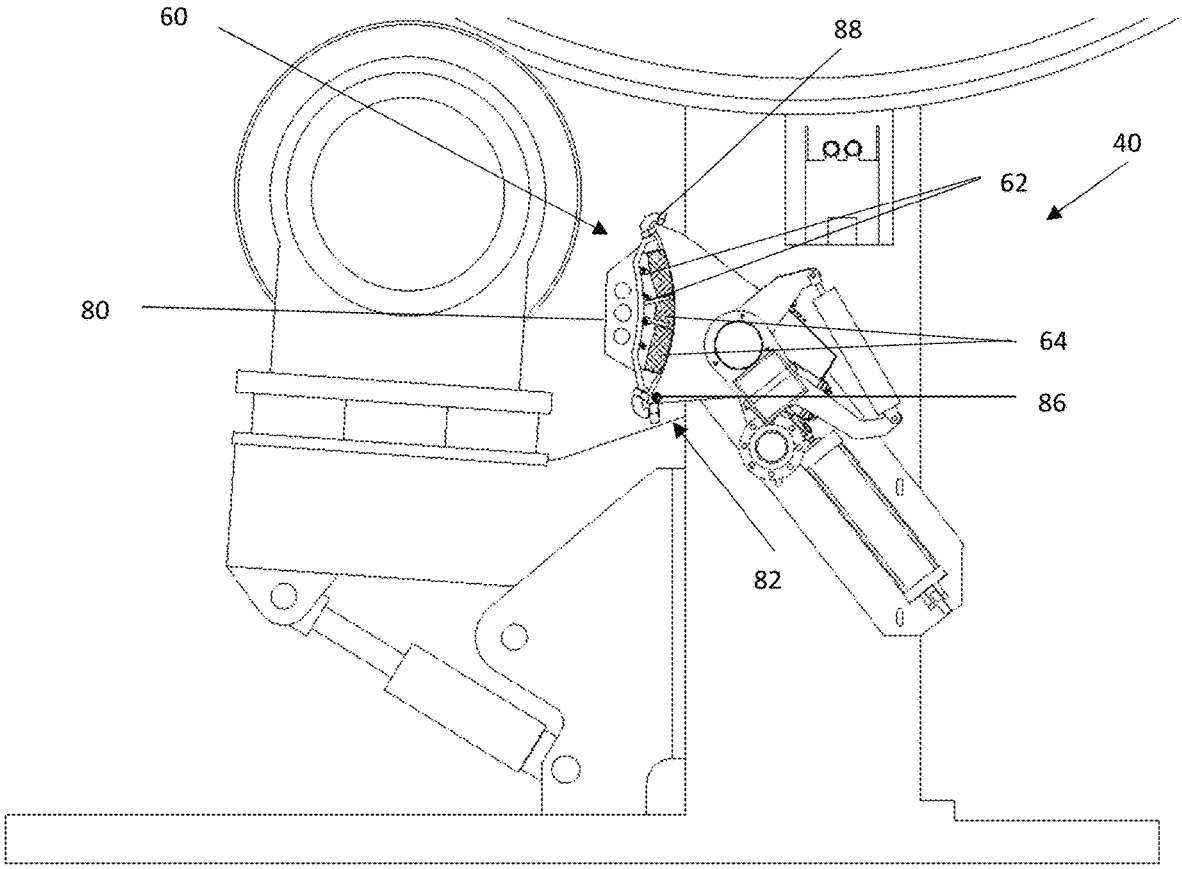
FIG. 13 is a side view of cleaning system connected to and cleaning a steam box.

FIG. 13 is a side view of a steam box 40 with a cleaning system 60. The cleaning system 60 includes a cleaning carriage 80 that moves along the steam box 40. The cleaning carriage 80 includes showers 62 and brushes 64 that clean the steam box 40 as the cleaning carriage 80 moves along the steam box 40. The cleaning carriage 80 includes a connector 82 including movement members 88 that extend around a support track 86 to movably connect the cleaning carriage 80 to the steam box 40.

Figure 14:
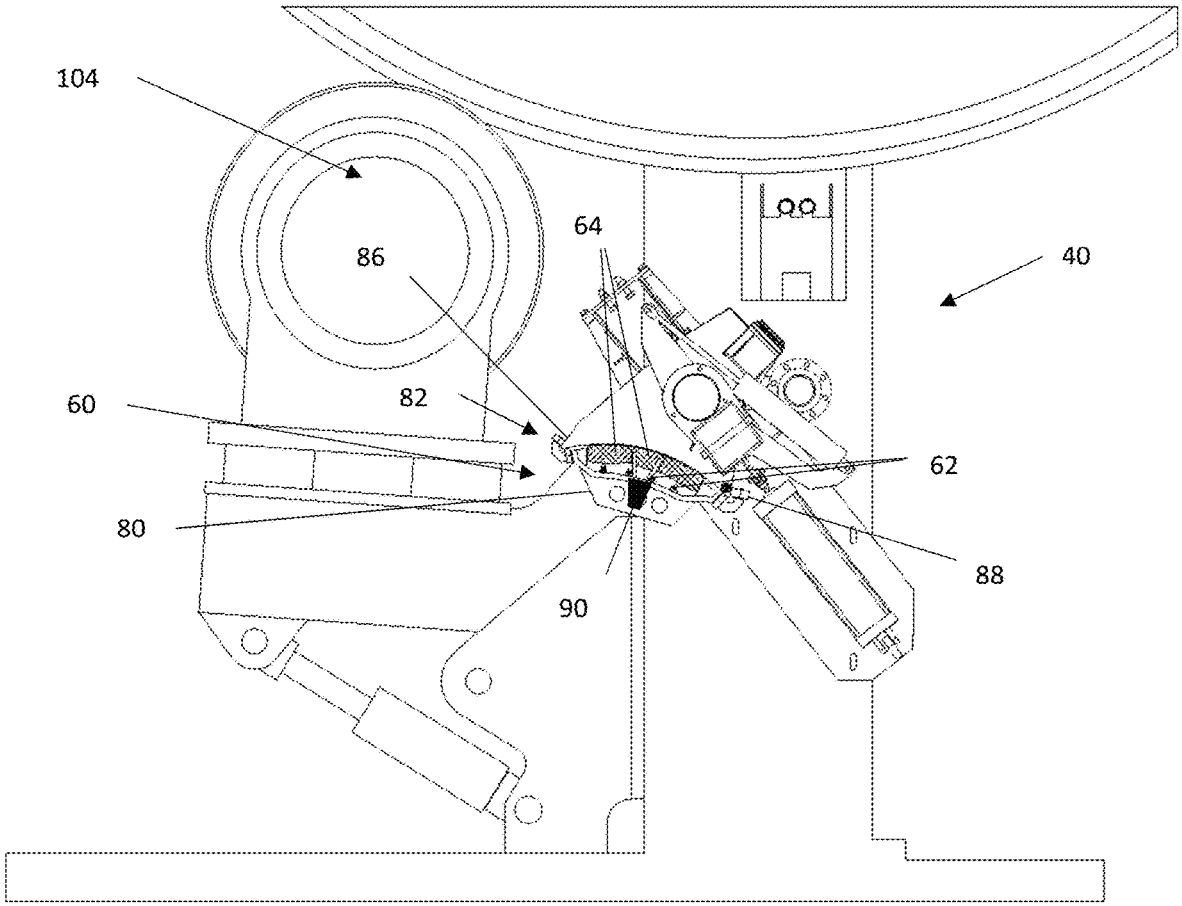
FIG. 14 is a side view of the cleaning system of FIG. 13 in communication with a steam box that is in a rotated position.

FIG. 14 is a side view of a steam box 40 with a cleaning system 60. The cleaning system 60 includes a cleaning carriage 80 that moves along the steam box 40. The cleaning carriage 80 includes showers 62 and brushes 64 that clean the steam box 40 as the cleaning carriage 80 moves along the steam box 40. The cleaning carriage 80 includes a connector 82 including movement members 88 that extend around a support track 86 to movably connect the cleaning carriage 80 to the steam box 40. The cleaning carriage 80 also includes a removal system 90 that collects fluid and debris that are removed during cleaning. The cleaning carriage 80 as shown is cleaning the steam box 40 while the steam box is in the rotated position 104.

Figure 15:
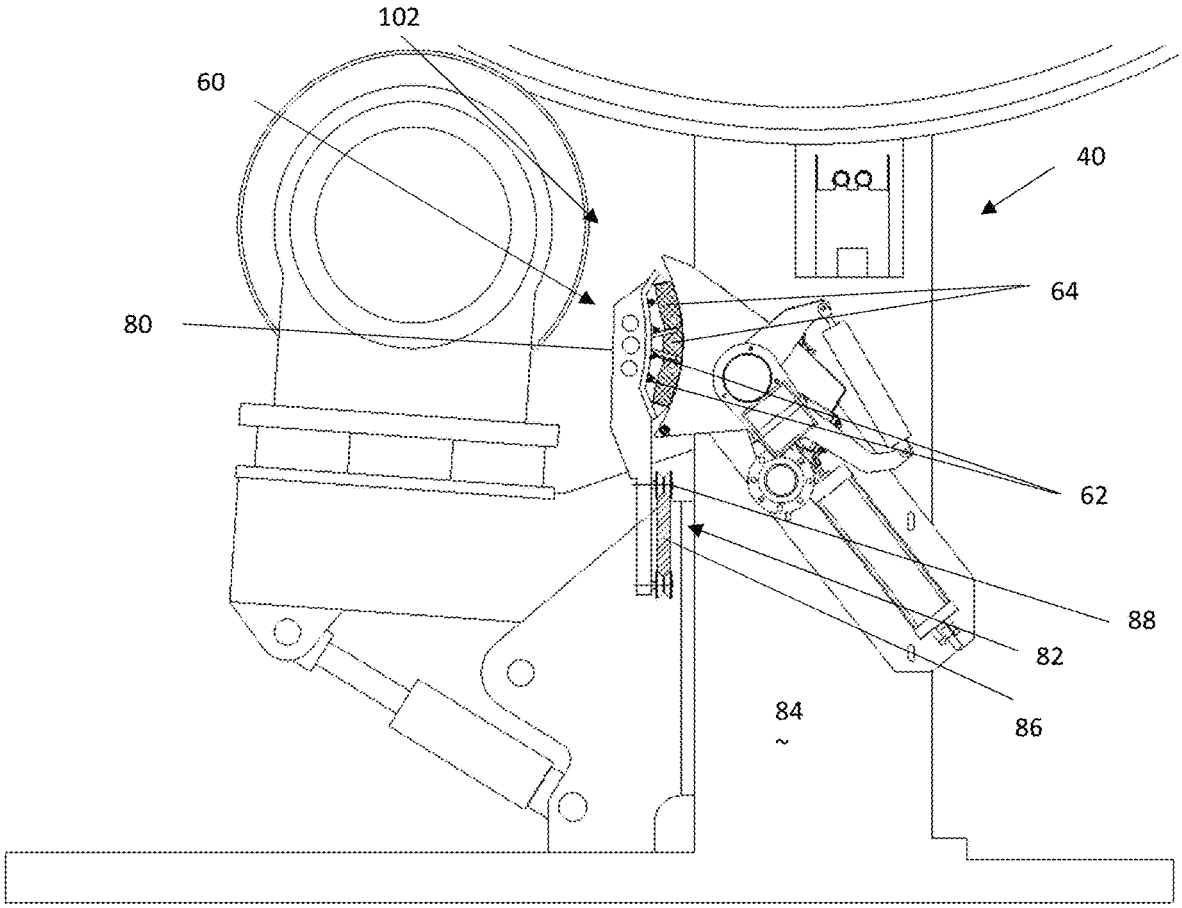
FIG. 15 is a side view of a cleaning system in communication with and cleaning a steam box.

FIG. 15 is a side view of a steam box 40 with a cleaning system 60. The cleaning system 60 includes a cleaning carriage 80 that moves along the steam box 40. The cleaning carriage 80 includes showers 62 and brushes 64 that clean the steam box 40 as the cleaning carriage 80 moves along the steam box 40. The cleaning carriage 80 includes a connector 82 including movement members 88 that are shown as rollers, which move along a support track 86. The support track 86 is connected to an extends from a support frame 84. The support track 86 runs along a cross-machine length of the paper machine. The cleaning carriage 80 as shown is cleaning the steam box 40 while the steam box is in the retracted position 102.

Figure 16:
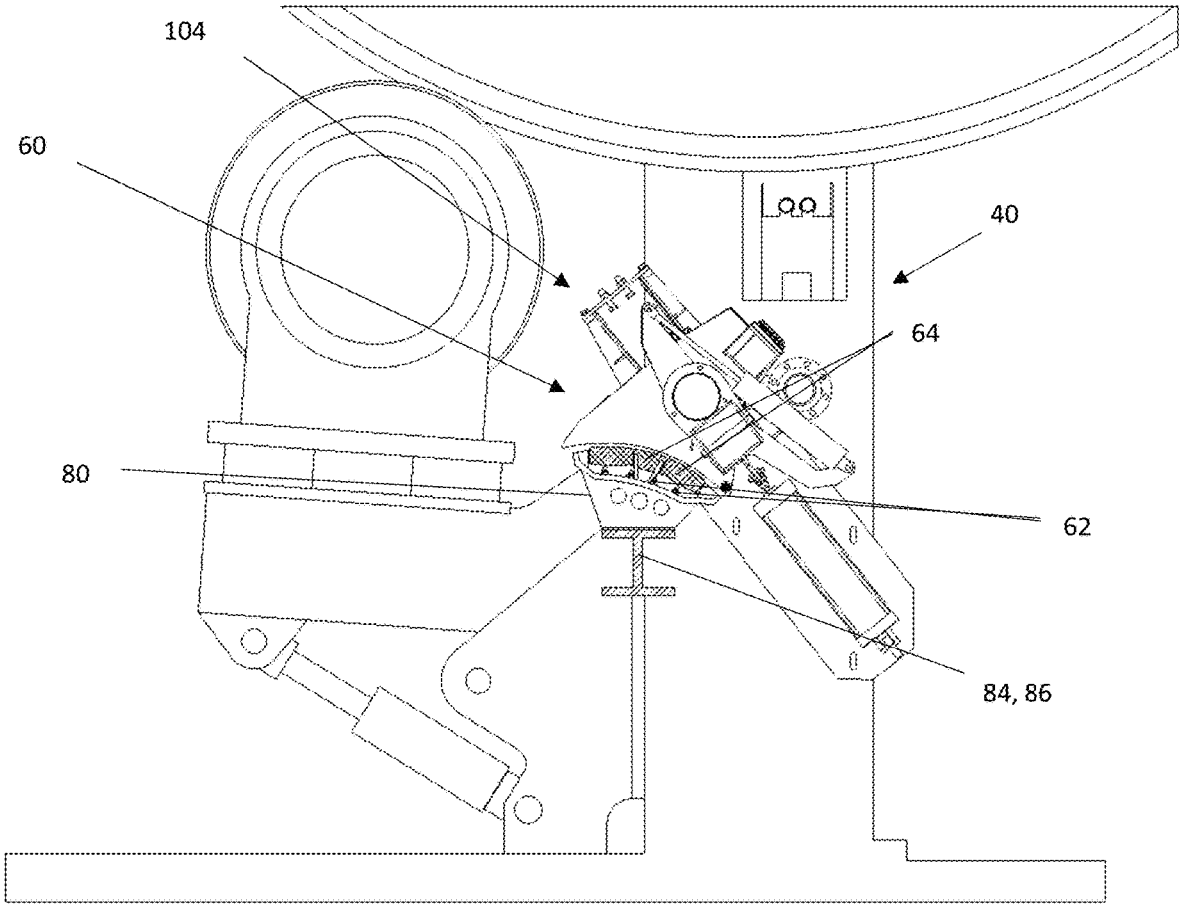
FIG. 16 is a side view of a cleaning system in communication with and cleaning a steam box that is in a rotated position.

FIG. 16 is a side view of a steam box 40 with a cleaning system 60. The cleaning system 60 includes a cleaning carriage 80 that moves along the steam box 40. The cleaning carriage 80 includes showers 62 and brushes 64 that clean the steam box 40 as the cleaning carriage 80 moves along the steam box 40. The cleaning carriage 80 is movable along a support frame 84, which is also a support track 86. The support track 86 runs along a cross-machine length of the paper machine. The cleaning carriage 80 as shown is cleaning the steam box 40 while the steam box is in the rotated position 104.

Variation 1 may comprise: a system comprising: (a) housing; (b) a support arm; and (c) rotary actuator that rotates a steam box between a working position and a rotated position.

Variation 2 may comprise the steam box of variation 1, and may comprise the steam box includes a linear actuator that linearly moves the steam box towards and away from the working position.

Variation 3 may comprise the steam box of any of the preceding variations and may comprise, wherein the steam box includes a rotation arm connected to the rotary actuator.

Variation 4 may comprise the steam box of any of the preceding variations and may comprise, wherein the steam box is rotated 45 degrees or more between the working position and the rotated position.

Variation 5 may comprise the steam box of any of the preceding variations and may comprise, wherein the support arm is located on each end of the housing.

Variation 6 may comprise the steam box of any of the preceding variations and may comprise, wherein the rotary actuator is located on each end of the housing.

Variation 7 may comprise the steam box of any of the preceding variations and may comprise, wherein the rotary actuator is in communication with a rotation arm and the rotary actuator moves the rotation arm to move the steam box.

Variation 8 may comprise the steam box of any of the preceding variations and may comprise, wherein steam box includes a pivot and the steam box is pivoted about the pivot between the working position and the rotated position.

Variation 9 may comprise the steam box of any of the preceding variations and may comprise, wherein the support arm includes a guide that controls movement of the steam box relative to the support arm.

Variation 10 may comprise: a system comprising: (a) a steam box and optionally the steam box of any of variations 1-9; and (b) a monitoring system that monitors cleanliness of the steam box.

Variation 11 may comprise the system of any of the preceding variations or variation 10 and may comprise, wherein the monitoring system visually inspects that steam box.

Variation 12 may comprise the system of any of the preceding variations and may comprise, wherein the monitoring system monitors a pressure of the steam box.

Variation 13 may comprise the system of any of the preceding variations and may comprise, wherein the monitoring system includes sensors.

Variation 14 may comprise the system of any of the preceding variations or variation 13 and may comprise, wherein the sensors are located coplanar with the steam box when the steam box in is a rotated position.

Variation 15 may comprise the system of any of the preceding variations and may comprise, wherein the sensors are movable along a face of the steam box.

Variation 16 may comprise the system of any of the preceding variations and may comprise, wherein the sensors monitor the system during use, after a cleaning cycle, or both.

Variation 17 may comprise the system of any of the preceding variations and may comprise, wherein the system includes a cleaning system.

Variation 18 may comprise the system of any of the preceding variations and may comprise, wherein the cleaning system includes a mechanical cleaning device.

Variation 19 may comprise the system of any of the preceding variations and may comprise, wherein the mechanical cleaning device is a brush, a scraper, or both.

Variation 20 may comprise the system of any of the preceding variations and may comprise, wherein the cleaning system includes a fluid cleaning device.

Variation 21 may comprise the system of any of the preceding variations and may comprise, wherein the fluid cleaning device is a pneumatic cleaning device, a hydraulic cleaning device, or both.

Variation 22 may comprise the system of any of the preceding variations and may comprise, wherein the fluid cleaning device includes shower nozzles.

Variation 23 may comprise the system of any of the preceding variations and may comprise, wherein the monitoring system includes cameras.

Variation 24 may comprise: a system comprising: (a) a steam box and optionally a steam box of any of variations 1-9; and (b) a cleaning system that moves relative to the steam box to clean the steam box; and optionally the system of any of variations 10 through 23.

Variation 25 may comprise the system of any of the preceding variations and may comprise, wherein the cleaning system includes shower nozzles spaced apart along a face of the steam box and the shower nozzles are movable relative to the face of the steam box to clean the steam box.

Variation 26 may comprise the system of any of the preceding variations and may comprise, wherein the system includes a mechanical cleaning device that contacts the steam box to clean the steam box.

Variation 27 may comprise the system of any of the preceding variations and may comprise, wherein the cleaning system includes a hydraulic cleaning system that sprays a fluid on the steam box and moves the spray about the steam box.

Variation 28 may comprise the system of any of the preceding variations and may comprise, wherein the cleaning system includes a cleaning carriage.

Variation 29 may comprise the system of any of the preceding variations and may comprise, wherein the cleaning carriage is movable along the steam box.

Variation 30 may comprise the system of any of the preceding variations and may comprise, wherein the cleaning carriage includes brushes, showers, or both.

Variation 31 may comprise the system of any of the preceding variations and may comprise, wherein the cleaning carriage includes a removal system.

Variation 32 may comprise the system of any of the preceding variations and may comprise, wherein the cleaning carriage includes movement members that retain the cleaning carriage proximate to the steam box and assist in moving the cleaning carriage along the steam box.

Variation 33 may comprise: a method comprising: (a) monitoring a steam box, optionally a steam box of any of variations 1-9, for cleanliness using a monitoring system; (b) cleaning a steam box with one or more cleaning devices that are movable about a face of the steam box, and optionally the cleaning system of any of variations 24-32; (c) rotating a steam box from a working position to a rotated position; (d) or a combination of a, b, and c, and optionally monitoring with any of variations 10 through 23.

Variation 34 may comprise the method, system, or steam box of any of the preceding variations and may comprise, wherein the step of monitoring includes using a monitoring system of any of variations 10 through 23.

Variation 35 may comprise the method, system, or steam box of any of the preceding variations and may comprise, wherein the step of cleaning includes using a cleaning system of any of variations 24 through 32.

Variation 36 may comprise the method, system, or steam box of any of the preceding variations and may comprise, wherein the step of rotating includes using a rotary actuator of any of variations 1 through 9.

Variation 37 may comprise the method, system, or steam box of any of the preceding variations and may comprise, wherein the monitoring system monitors the steam box after a cleaning cycle is performed.

Variation 38 may comprise the method, system, or steam box of any of the preceding variations and may comprise, wherein the monitoring system includes cameras.

Variation 39 may comprise the method, system, or steam box of any of the preceding variations and may comprise, comprising cleaning with a fluid.

Variation 40 may comprise the method, system, or steam box of any of the preceding variations and may comprise, comprising cleaning with a brush.

Variation 41 may comprise the method, system, or steam box of any of the preceding variations and may comprise, comprising cleaning with a fluid before cleaning with a brush.

Variation 42 may comprise the method, system, or steam box of any of the preceding variations and may comprise, comprising moving a cleaning carriage across the face of the steam box.

Variation 43 may comprise the method, system, or steam box of any of the preceding variations and may comprise, comprising removing fluid, debris, or both with a removal system.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

2 Paper Machine
3 Slice Opening
4 Headbox
5 Breast Roll
6 Wire
7 Forming Board
8 Foil Sections
9 Foil
10 Couch Roll
11 Frame
12 Return Roll
14 Machine Direction
16 Tending Side
18 Back Side
20 Monitoring System
22 Light
24 Sensor
26 Vacuum Roll
28 Yankee Dryer
40 Steam Box
42 Housing
44 Diffuser
46 Valve
48 Steam Header
49 Support Arm
50 Linear Actuator
52 Rotary Actuator
54 Pivot
56 Zone Feed Pipe
57 Guide
58 Slide
60 Cleaning System
62 Pneumatic or Hydraulic Cleaning Device (Shower)
64 Mechanical Cleaning Device (Brush)
66 Movement Arm
68 Actuator
70 Cleaning Pivot
72 Start Position
74 End Position
76 Nozzle
78 Pressure Gauge
80 Cleaning Carriage
82 Connector
84 Support Frame
86 Movement Member
90 Removal System
100 Working Position
102 Retracted Position
104 Rotated Position

We claim:

1. A system comprising:

a. a steam box comprising:
   i. a housing and
   ii. a diffuser;

b. a support arm connected to and extending from the housing of the steam box and supporting the housing of the steam box;

c. a rotary actuator that rotates the housing and the diffuser of the steam box between a working position where the diffuser faces a portion of a paper machine and a rotated position where the diffuser faces away from the portion of the paper machine, and wherein the housing and the diffuser rotate relative to the paper machine and the support arm; and d. a rotation arm in communication with the rotary actuator so that the rotary actuator moves the rotation arm to move the steam box.

2. The system of claim 1, wherein the steam box includes a linear actuator that linearly moves the steam box towards and away from the portion of the paper machine along the support arm.

3. The system of claim 1, wherein the housing and the diffuser of the steam box are rotated 45 degrees or more between the working position and the rotated position relative to the support arm.

4. The system of claim 1, wherein the steam includes a pivot and the steam box is pivoted about the pivot between the working position and the rotated position.

5. The system of claim 1, wherein the support arm includes a guide that controls movement of the steam box relative to the support arm.

6. The system of claim 1 further comprising:

a monitoring system that monitors cleanliness of the steam box configured to connect to a paper machine.

7. The system of claim 6, wherein the monitoring system visually inspects the steam box.

8. The system of claim 6, wherein the monitoring system monitors a pressure of the steam box.

9. The system of claim 6, wherein the monitoring system includes sensors that are located coplanar with the steam box when the steam box in is a rotated position.

10. The system of claim 9, wherein the sensors are movable along a face of the steam box.

11. The system of claim 6, wherein the sensors monitor the steam box during use, after a cleaning cycle, or both.

12. The system of claim 6, wherein the system includes a cleaning system that is a mechanical cleaning device, a fluid cleaning device, or both.

13. The system of claim 6, wherein the monitoring system includes cameras.

14. The system of claim 1 further comprising:

a cleaning system that moves relative to the steam box to clean the steam box that is configured to be connected to a paper machine.

15. The system of claim 14, wherein the cleaning system includes shower nozzles spaced apart along a face of the steam box and the shower nozzles are movable relative to the face of the steam box to clean the steam box.

16. The system of claim 14, wherein the system includes a mechanical cleaning device that contacts the steam box to clean the steam box.

17. The system of claim 14, wherein the cleaning system includes a hydraulic cleaning system that sprays a fluid on the steam box and moves the spray about the steam box.

18. The system of claim 14, wherein the cleaning system includes a cleaning carriage that is movable along the steam box.

* * * * *